US006733007B2

(12) United States Patent
Sekiyama et al.

(10) Patent No.: US 6,733,007 B2
(45) Date of Patent: May 11, 2004

(54) SHEET MATERIAL CONVEYING DEVICE; IMAGE FORMING APPARATUS AND SHEET PROCESSING DEVICE

(75) Inventors: Junichi Sekiyama, Shizuoka (JP); Yasuyoshi Hayakawa, Shizuoka (JP); Tomoyuki Araki, Shizuoka (JP); Masayoshi Fukatsu, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 54 days.

(21) Appl. No.: 10/234,237

(22) Filed: Sep. 5, 2002

(65) Prior Publication Data

US 2004/0046311 A1 Mar. 11, 2004

(51) Int. Cl.[7] ..... B65H 39/10; B65H 29/00

(52) U.S. Cl. ..... 271/65; 493/405

(58) Field of Search ..... 271/65, 279, 291, 271/297, 301, 303; 493/405–464; B65H 39/10, 29/00, 29/66

(56) References Cited

U.S. PATENT DOCUMENTS

| | | | | |
|---|---|---|---|---|
| 4,307,800 A | * | 12/1981 | Joa | 198/374 |
| 5,154,411 A | | 10/1992 | Saito et al. | 271/289 |
| 5,155,537 A | | 10/1992 | Komatsu et al. | 355/309 |
| 5,292,116 A | | 3/1994 | Inoue et al. | 271/157 |
| 5,348,284 A | | 9/1994 | Ishihama et al. | 271/160 |
| 5,501,444 A | | 3/1996 | Yukimachi et al. | 271/127 |
| 5,651,540 A | | 7/1997 | Watanabe et al. | 271/10.12 |
| 5,967,505 A | * | 10/1999 | Lin et al. | 271/4.01 |
| 6,206,369 B1 | | 3/2001 | Hoshii et al. | 271/290 |
| 6,276,677 B1 | * | 8/2001 | Hommochi et al. | 270/32 |
| 6,302,606 B1 | | 10/2001 | Hayakawa et al. | 400/625 |
| 6,318,718 B1 | | 11/2001 | Ogata et al. | 271/213 |
| 6,325,371 B1 | | 12/2001 | Araki et al. | 271/297 |
| 6,328,303 B1 | * | 12/2001 | Maetani | 271/273 |
| 6,371,471 B1 | * | 4/2002 | Fukazu et al. | 270/58.09 |
| 6,382,616 B1 | | 5/2002 | Waragai et al. | 270/58.12 |
| 6,575,301 B2 | * | 6/2003 | Simhaee | 206/554 |

FOREIGN PATENT DOCUMENTS

| | | | | |
|---|---|---|---|---|
| JP | 61-2670 | * | 1/1986 | B65H/45/14 |

* cited by examiner

*Primary Examiner*—Donald P. Walsh
*Assistant Examiner*—Kenneth W Bower
(74) *Attorney, Agent, or Firm*—Fitzpatrick, Cella, Harper & Scinto

(57) ABSTRACT

A sheet material conveying device being capable of conveying a folded sheet material that is discharged from an image forming apparatus for forming an image on a sheet material, include: a first conveying path for discharging the folded sheet as it is; a second conveying path branching out from the first conveying path a third conveying path, which branches out from the second conveying path and is connected with the first conveying path, for conveying the sheet material in an opposite direction to a conveying direction of the sheet material in the second conveying path; first switching means for selectively guiding the sheet material to either the first conveying path or the second conveying path; and second switching means for guiding the sheet material guided to the second conveying path to the third conveying path.

28 Claims, 22 Drawing Sheets

SHEET MATERIAL CONVEYING DEVICE; IMAGE FORMING APPARATUS AND SHEET PROCESSING DEVICE

BACKGROUND OF THE INVENTION

1. Field of the Invention

The present invention relates to a sheet material conveying device for conveying a sheet material folded by being subjected to folding processingan, image forming apparatus equipped with the sheet material conveying device, and sheet processing device.

2. Description of the Related Art

Up to now, in a sheet post-processing device having a function of easily making a sheet material or a bundle of sheet materials (hereinafter simply referred to as a pamphlet) which has undergone folding processing, there is given, as a method of stacking prepared pamphlets, a stacking method of making a discharged pamphlet fall on a stacking portion and sequentially piling pamphlets.

Further, as in a large bookbinding device, there is given a stacking method of not piling but shifting discharged pamphlets in a transverse direction while sequentially conveying the pamphlets forward by means of a belt conveyor member.

However, in the case of the prior art as described above, there has been the following problem. In general, the vicinity on the folded side of a pamphlet is easier to swell compared with the opposite side. Thus, in the case where pamphlets are simply aligned in the folded side to be stacked, the uppermost stacking surface is not stable, stacking property is poor, and the number of stacked sheets is small to a staking space.

Further, also in the stacking method of shifting discharged pamphlets in a transverse direction while sequentially conveying the pamphlets forward by means of a belt conveyor member as in the large bookbinding device, a large stacking space is required.

Therefore, in a simple pamphlet stacking device used in an office space or the like as well, there is needed a device of an alternative stacking type which is small and inexpensive, which does not need a large area, and which enables mass stacking. Further, it is necessary to provide the pamphlet stacking device with an additional function that is inexpensive but corresponds to an application of an office.

SUMMARY OF THE INVENTION

The present invention has been made to solve the above-described problem in the prior art, and has an object to provide a sheet material conveying device, image forming apparatus, and sheet processing device in which stacking property of a sheet material and a pamphlet can be improved without increasing a stacking space.

In order to achieve the above object, there is provided a sheet material conveying device being capable of conveying a folded sheet material that is discharged from an image forming apparatus for forming an image on a sheet material, including:

a first conveying path for discharging the folded sheet as it is;

a second conveying path branching out from the first conveying path;

a third conveying path, which branches out from the second conveying path and is connected with the first conveying path, for conveying the sheet material in an opposite direction to a conveying direction of the sheet material in the second conveying path;

first switching means for selectively guiding the sheet material to either the first conveying path or the second conveying path; and second switching means for guiding the sheet material guided to the second conveying path to the third conveying path.

Further, a sheet material conveying device according to the present invention is characterized in that:

the second conveying path is provided with a pair of conveying rollers composed of two conveying rollers for conveying a sheet material to the second conveying path;

the second conveying path is curved; and the conveying roller on the curved inner side of the pair of conveying rollers is a driving roller.

Further, a sheet material conveying device according to the present invention is characterized in that a nip of the pair of conveying rollers is in proximity to the curved inner side.

Further, a sheet material conveying device according to the present invention is characterized in that an inclination angle of stacking means for stacking the conveyed sheet material with respect to a horizontal plane is 20 to 45 decrees.

Further, a sheet material conveying device according to the present invention is characterized by further including detecting means for detecting a height of a sheet material stacked on stacking means for stacking the conveyed sheet material, in which an initial operation for controlling a height of the stacking means is performed based on the detection result of the detecting means.

Further, a sheet material conveying device according to the present invention is characterized in that the initial operation is performed with a predetermined time interval.

Further, a sheet material conveying device according to the present invention is characterized in that the detecting means includes light emitting means for emitting light, light receiving means for receiving light emitted from the light emitting means, and light shielding means for shielding light which enters from the light emitting means to the light receiving means in accordance with the height of the stacking means.

Further, a sheet material conveying device according to the present invention is characterized in that the first switching means is alternately controlled in accordance with a predetermined operation procedure sent by the image forming apparatus.

Further, a sheet material conveying device according to the present invention is characterized by further including a sensor flag for detecting an angle of a straight line connecting at least two points on an upper surface or a sheet material on stacking means on which the conveyed sheet material is stacked, in which a switching operation of the first switching means is controlled based on the detection result of the sensor flag.

Further, a sheet material conveying device according to the present invention is characterized in that the sensor flag includes at least a first sensor flag arranged on the downstream side in the conveying direction of the sheet material on the stacking means and a second sensor flag arranged on the upstream side in the conveying direction of the sheet material on the stacking means; and the sensor flag detects the angle of a straight line connecting at least two points on an upper surface of a sheet material on stacking means on which the conveyed sheet material is stacked based on detection signals output from the first sensor flag and the second sensor flag.

Further, a sheet material conveying device according to the present invention is characterized by further including a tip end detection sensor flag for detecting a tip end of a sheet material conveyed to the first conveying path, in which a size of the conveyed sheet material is detected based on the detection time of the tip end detection sensor flag.

Further, a sheet material conveying device according to the present invention is characterized by further including:

a fourth conveying path for conveying a sheet material to the fist conveying path through folding processing means for conducting folding processing to the sheet material discharged from the image forming apparatus;

a fifth conveying path for conveying the sheet material discharged from the image forming apparatus to the first conveying path not through the folding processing means; and third switching means for selectively guiding the sheet material to either the fourth conveying path or the fifth conveying path.

Further, a sheet material conveying device according to the present invention is characterized by further including:

a sixth conveying path branching out from the second conveying path;

processing means for processing a sheet material that is being conveyed through the sixth conveying path;

a seventh conveying path for conveying the sheet material discharged from the processing means to the first conveying path; and fourth switching means for switching performing conveyance of the sheet material through the sixth conveying path and not performing conveyance thereof.

Further, a sheet material conveying device according to the present invention is characterized in that the processing means includes a Z-folding unit for Z-folding the sheet material.

Further, a sheet material conveying device according to the present invention is characterized in that the processing means includes a puncher unit for forming a punch hole in the sheet material.

Further, a sheet material conveying device according to the present invention is characterized in that the processing means includes a pasting processing unit for conducting pasting to the sheet material.

Further, a sheet material conveying device according to the present invention is characterized in that at least a part of a wall of a conveying path constituting the second conveying path consists of a conveying roller.

Further, a sheet material conveying device according to the present invention is characterized in that a stacking surface of stacking means for stacking the conveyed sheet material has a first angle that faces upward from the upstream side in the conveying direction of the sheet material to an inflection point positioned on the downstream side and has a second angle that faces downward compared with the first angle from the inflection point to the downstream side.

Further, a sheet material conveying device according to the present invention is characterized by further including:

an eighth conveying path for discharging a sheet material as it is which is discharged from the image forming apparatus, and conveying the sheet material to a post-processing device;

a ninth conveying path branching out from the eighth conveying path;

a tenth conveying path, which branches out from the ninth conveying path, for guiding the sheet material guided to the ninth conveying path to the eighth conveying path;

fifth switching means for selectively guiding the sheet material to either the eighth conveying path or the ninth conveying path;

sixth switching means for guiding the sheet material from the ninth conveying path to the tenth conveying path; and an eleventh conveying path connected with the ninth conveying path and connected with the first conveying path.

Further, a sheet material conveying device according to the present invention is characterized in that the post-processing device is a stapling unit for conducting stapling processing to the sheet material.

Further, a sheet material conveying device according to the present invention is characterized by further including a twelfth conveying path for conveying the sheet material to the first conveying path through folding processing means for conducting folding processing to the sheet material discharged from the post-processing device.

Further, a sheet material conveying device according to the present invention is characterized by further including a thirteenth conveying path for conveying the sheet material to the first conveying path not through folding processing means for conducting folding processing to the sheet material discharged from the post-processing device.

Further, a sheet material conveying device according to the present invention is characterized by further including:

driving means for driving the entire device;

fixing means for detachably and attachably fixing the sheet material conveying device to the post-processing device;

communication means for conducting transfer of information between the sheet material conveying device and the post-processing device; and drive control means for controlling a drive of the driving means based on the communication result of the communication means.

Further, an image forming apparatus according to the present invention is characterized by including image forming means for forming an image on a sheet material, in which the sheet material on which the image is formed is discharged to the sheet material conveying device as claimed in any of claims 1 to 23 by means of the image forming means.

Further, a sheet processing device according to the present invention is characterized by including:

a pair of folding rollers for sandwiching a loop portion formed in a sheet and folding the sheet;

a pair of discharge rollers for discharging a sheet;

a first conveying path for guiding the sheet folded by the pair of folding rollers to the pair of discharge rollers;

a pair of switchback rollers for conveying the sheet in a switchback manner;

a switching flapper for selectively guiding the sheet to the first conveying path or the pair of switchback rollers; and a guide for guiding the sheet, which has been guided to the pair of switchback rollers by the switching flapper and conveyed in a switchback manner by the switchback rollers, so that the sheet joins the first conveying path.

Further, a sheet processing device according to the present invention is characterized in that the switching flapper guides second predetermined number of sheets, which is at least one, to the pair of switchback rollers every time the switching flapper guides first predetermined number of sheets, which is at least one, to the first conveying path.

Further, a sheet processing device according to the present invention is characterized by further including a control circuit for controlling the switching flapper and the switchback rollers.

Further, an image forming apparatus according to the present invention is characterized by including image forming means for forming an image on a sheet and the sheet processing device for conducting processing to the sheet on which the image is formed by the image forming means.

As described above, according to the present invention, the sheet material conveying device is arranged downstream of the post-processing device having a function of conducting saddle-stitch folding processing, and receives a pamphlet discharged from the post-processing device with the folded side as the leading end and selectively inverts the received pamphlet to stack it on the stacking means. Thus, alternate stacking is possible in which the folded sides of pamphlets are not superimposed. Accordingly, pamphlet stacking property can be improved, and an improvement in stacking amount can be realized.

Further, differently from a mode in which pamphlets are inverted to be alternately stacked by predetermined number of sheets, it is possible that: an actual inclination of the stacking surface is detected by a plurality of sensor flags for detecting heights of at least two parts on the upper surface of the pamphlet actually stacked on the stacking means; and based on the detection result, the pamphlet inversion is selectively controlled, whereby pamphlets having different swells are mixedly and alternately stacked.

Further, control is conducted in which the pamphlet inversion is alternately conducted for each job such as a printing job, for example, whereby job separation can be realized.

Further, the sheet material conveying device is provided with both the fourth conveying path and the twelfth conveying path, which are pamphlet receiving conveying paths for receiving a pamphlet from a post-processing device, and the fifth conveying path and the thirteenth conveying path, which are sheet material receiving conveying paths for receiving a not-folded sheet material from the post-processing device. Therefore, in the case where the sheet material conveying device is connected with the post-processing device provided with both a pamphlet discharging function of conducting saddle-stitch folding processing to the sheet material received from the image forming apparatus and discharging the sheet material with the folded side thereof as the leading end and a sheet discharging function of not conducting saddle-stitch folding processing to the sheet material and discharging the sheet material as it is, the sheet material conveying device can also be used as a mass stacker that realizes an increase in stacking amount of a sheet material in addition to the use as a pamphlet alternate stacking device.

Further, a large area can be secured in a lower space. Thus, the sixth conveying path branching out from the midway of the second conveying path and the processing means for conducting sheet folding (for example, Z-folding or C-folding), pastebinding, punching, or the like with respect to a sheet bundle, which is positioned downstream thereof, can be additionally provided.

The sheet material conveying device is provided with the seventh conveying path for conveying a sheet material processed by the processing means to the first conveying path, and thus, new sheet processing can be realized in addition to the pamphlet stacking function.

Further, when the sheet material conveying device is provided with sheet stacking means having a frame body which is different from standard stacking means in the above-mentioned area, further mass stacking is enabled.

Furthermore, the sheet material conveying device is arranged downstream of the post-processing device, and is provided with the fixing means, the communication means with the post-processing device, the driving means for driving the entire device, and the drive control means for controlling the driving means, thereby being a unit detachable and attachable with respect to the post-processing device. Thus, the sheet material conveying device can be applied to various kinds of post-processing devices.

As described above, according to the present invention, there can be switched the case where the folded sheet material is discharged to the stacking means from the first conveying path and the case where the folded sheet material is inverted through the second conveying path and the third conveying path to be discharged. Thus, the folded sides of the pamphlets can be appropriately combined to make the pamphlets discharged onto the stacking means. Therefore, pamphlet stacking property can be improved.

Other objects and effects of the present invention will be apparent from the detailed description below.

DETAILED DESCRIPTION OF THE PREFERRED EMBODIMENTS

Hereinafter, Preferred embodiments of the present invention will be described in detail taking examples with reference to the accompanying drawings. Incidentally, dimensions, materials, shapes, relative arrangements, and the like of structural components described in the embodiments do not have the aim of limiting the scope of the present invention thereto unless specific description is made.

Further, in the accompanying drawings, the same members as those in the previously mentioned drawings are denoted by the same reference symbols.

(First Embodiment)

Figure 1:
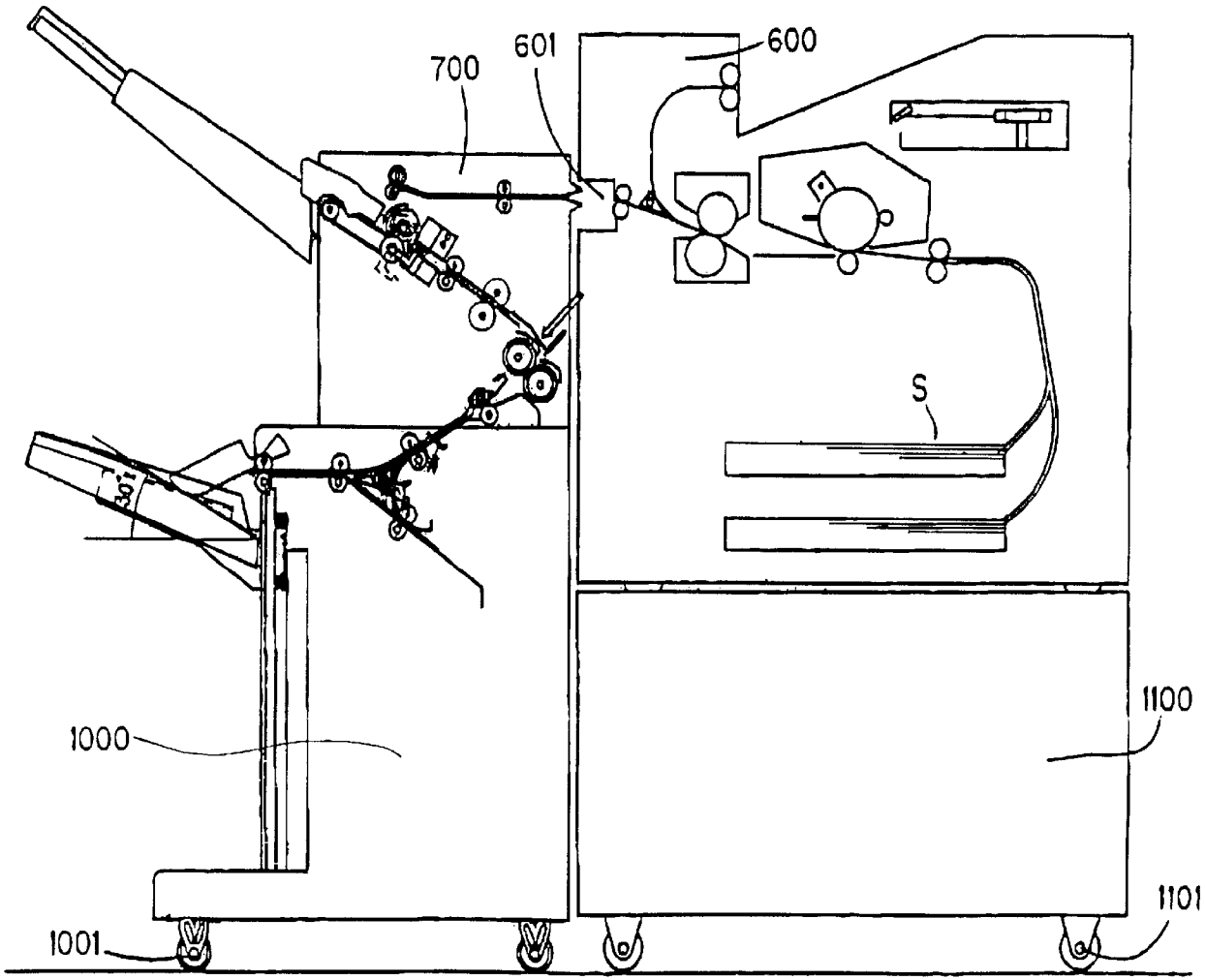
FIG. 1 is an entire structural diagram of a sheet material conveying device in accordance with a first embodiment of the present invention.
Figure 5:
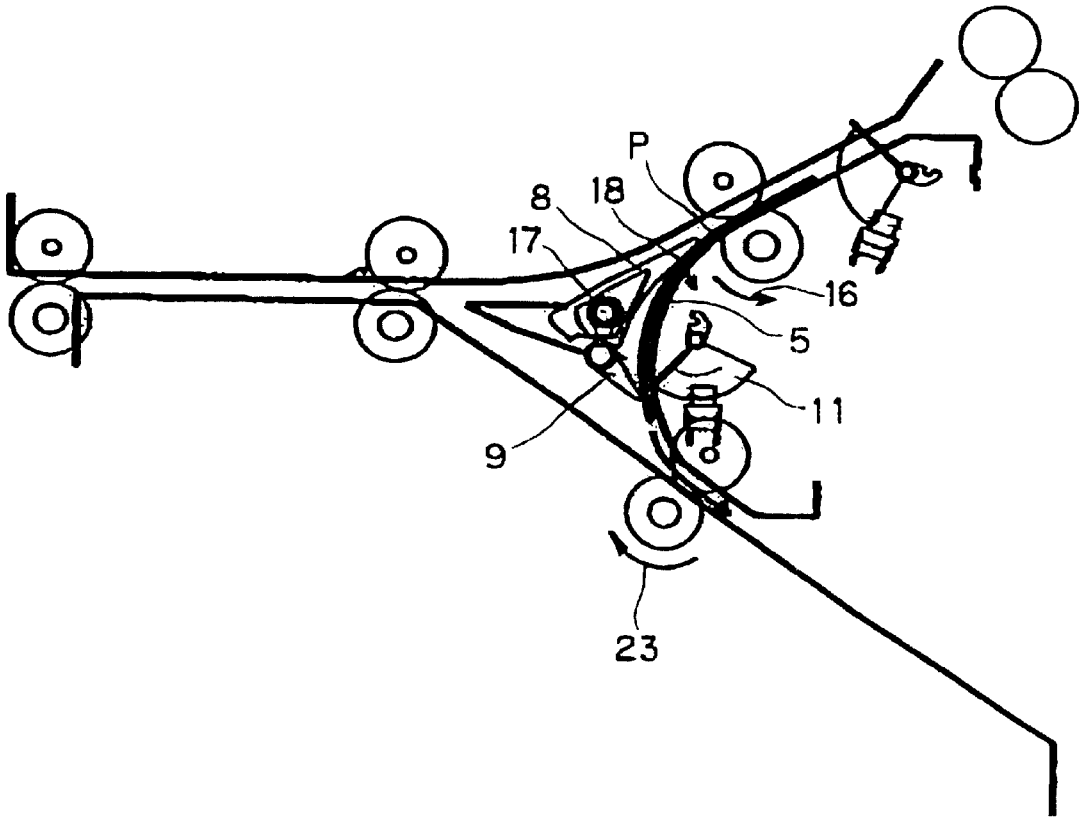
FIG. 5 is a partial sectional view of the sheet material conveying device in accordance with the first embodiment of the present invention.
Figure 6:
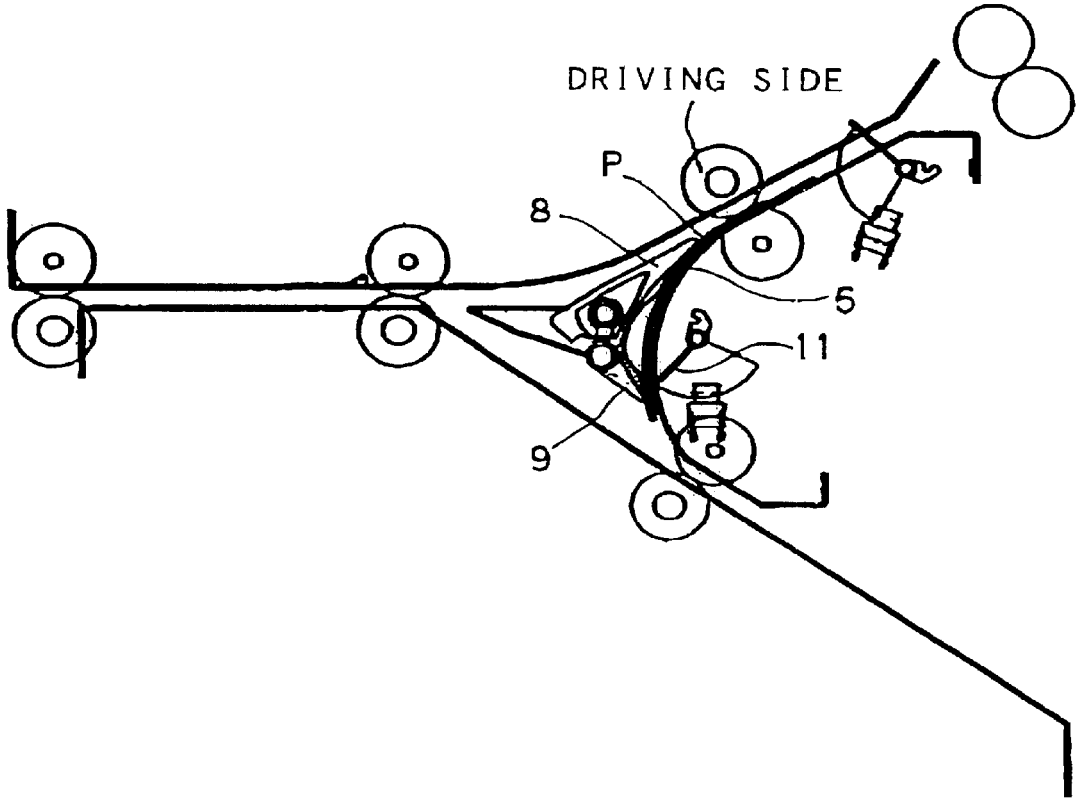
FIG. 6 is a partial sectional view of a sheet material conveying device in accordance with a comparative example for explaining the sheet material conveying device in accordance with the first embodiment of the present invention.

First, a sheet material conveying device in accordance with a first embodiment of the present invention will be described with reference to FIGS. 1 to 8. FIG. 1 is an entire structural diagram of the sheet material conveying device in accordance with the first embodiment of the present invention. FIGS. 2 to 5, 7 and 8 each area partial sectional view of the sheet material conveying device in accordance with the first embodiment of the present invention. FIG. 6 is a partial sectional view of a sheet material conveying device in accordance with a comparative example for explaining the sheet material conveying device in accordance with the first embodiment of the present invention.

(Description of Entire Structure)

In FIG. 1, reference numeral 600 denotes an image forming apparatus, and reference numeral 1100 denotes a feed deck, which feeds a sheet material S to the image forming apparatus 600. Reference numeral 700 denotes a sheet post-processing device, which receives the sheet material S from a face-up sheet discharge portion 601 of the image forming apparatus 600.

A pamphlet P made by being subjected to post-processing by the sheet post-processing device 700 is discharged and stacked on a stacking tray of a sheet material conveying device 1000 installed detachably attachable and downstream of the sheet post-processing device 700.

Further, the sheet material conveying device 1000 and the feed deck 1100 have casters 1001.

Next, the sheet material conveying device 1000 shown in FIG. 1 is explained with reference to FIG. 2.

First, description is mainly made of a structure of a pamphlet inverting portion. An arrow 1 denotes a first conveying path, an arrow 2 denotes a second conveying path, an arrow 3 denotes a third conveying path, and reference numerals 4, 5, 6, and 7 denote conveyance guide plates. Incidentally, the conveyance guide plate 5 is curved.

As to the first conveying path 1, the upstream portion is composed of the conveyance guide plate 4 and the curved conveyance guide plate 5, the midstream portion is composed of the conveyance guide plate 4, a substantially straight portion of an upper surface of a switching flapper 8 as a first switching means of the present invention, and an upper surface of the conveyance guide plate 6, and the downstream portion is composed of the conveyance guide plate 4 and the conveyance guide plate 7.

As to the second conveying path 2, the curve inner side portion is comprised of the conveyance guide plate 5, and the curve outer side portion is composed of a curved lower surface portion of the switching flapper 8 and an upper surface of a reversal preventing flapper 9 as a second switching means of the present invention.

As to the third conveying path 3, the upstream portion is composed of the conveyance guide plate 5 and the conveyance guide plate 7, the midstream portion is composed of a lower surface of the reversal preventing flapper 9, a lower surface of the conveyance guide plate 6, and the conveyance guide plate 7, and the downstream portion is composed of the conveyance guide plate 4 and the conveyance guide plate 7.

Reference numeral 10 denotes an inlet sensor flag as a sensor flag for detecting a tip end according to the present invention which is arranged in the midway of the first conveying path 1. The inlet sensor flag detects entrance of a tip end of the not-shown pamphlet P. Reference numeral 11 denotes a sensor flag for detecting passage of the not-shown pamphlet P, which is arranged in the midway of the second conveying path 2.

Reference numeral 12 denotes a pair of rollers for drawing-in a pamphlet as a pair of conveying rollers, which includes a roller 12*a* on a driving side and a roller 12*b* on a driven side. The driven roller is in press-contact with the driving roller by a not-shown elastic member. Further, a nip line formed by the pair of drawing-in rollers 12 is in proximity to the conveyance guide plate 5.

Reference numeral 13 denotes a pair of switchback rollers, which includes a roller 13*a* on a driving side and a roller 13*b* on a driven side. Similar to the pair of rollers 12, the driven roller is in press-contact with the driving roller by a not-shown elastic member.

Reference numerals 14 and 15 denote a pair of conveying rollers and a pair of discharge rollers, respectively, similar to the pair of rollers 12, which include a lower roller 14*a* and a lower roller 15*a* on a driving side and an upper roller 14*b* and an upper roller 15*b* on a driven side, respectively.

Similar to the pair of drawing-in rollers 12, the driven roller is in press-contact with the driving roller by a not-shown elastic member.

As to the pair of drawing-in rollers 12 and the pair of conveying rollers 14, a not-shown one-way clutch is attached to the driving roller.

Further, the pair of switchback rollers 13 is a pair of rollers, which enables normal and reverse rotation, and hereinafter is referred to as pair of SB rollers 13.

Next, explanation is made of an operation for inverting a pamphlet. Incidentally, the explanation is made from the state obtained immediately after the folded side of the not-shown pamphlet P made by the not-shown sheet material post-processing device is discharged by a pair of rollers 100 for discharging a pamphlet of the sheet material post-processing device.

First, the case where the pamphlet P is straightly discharged in a direction of the first conveying path 1 is described with reference to FIG. 3.

First, it is detected, by the inlet sensor flag 10 positioned at the upstream portion of the first conveying path 1, that the tip end of the not-shown pamphlet P, which is discharged from the pair of rollers 100 for discharging a pamphlet, has passed the inlet sensor flag 10.

Another pamphlet P is sequentially discharged from the pair of rollers 100 for discharging a pamphlet and drawn by the pair of drawing-in rollers 12 which rotates in an arrow 16 direction.

Figure 3:
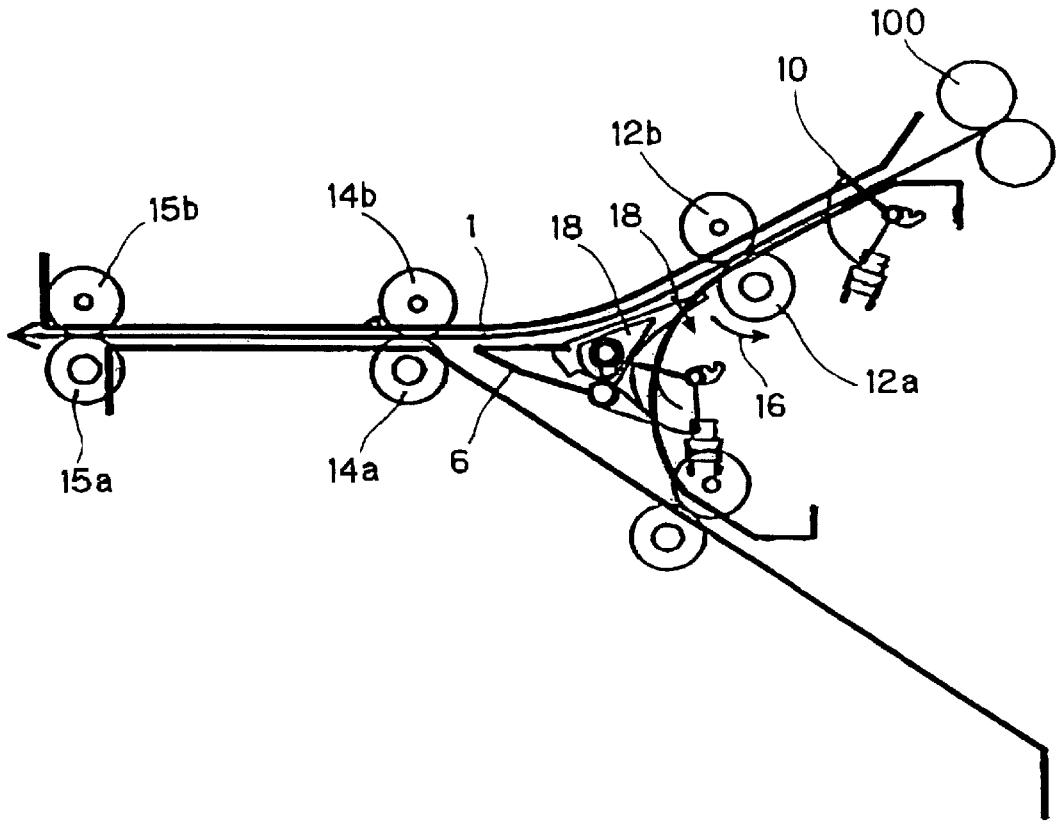
FIG. 3 is a partial sectional view of the sheet material conveying device in accordance with the first embodiment of the present invention.

The switching flapper 8 is provided downstream of the pair of rollers 12, and the flapper 8 is pulled by a not-shown spring in an arrow 18 direction with a rotational axis 17 as the center in the initial state and is positioned so as to overlap the conveyance guide plate 5 as shown in FIG. 3.

Thereafter, the pamphlet P that has massed the upper surface of the switching flapper 8 is drawn by the pair of conveying rollers 14, conveyed to the pair of discharge rollers 15, and discharged with the folded side as the leading end.

Next, the case where the pamphlet P is invertedly discharged is explained with reference to FIGS. 4 and 5. First, it is detected, by the inlet sensor flag 10 positioned at the upstream portion of the first conveying path 1, that the tip end of the pamphlet P, which is discharged from the pair of rollers 100 for discharging a pamphlet, has passed the inlet sensor flag 10.

In accordance with the tip end passage detection signal, the switching flapper 8 is pulled by a not-shown solenoid in an arrow 19 direction with the rotation axis 17 as the center.

Figure 4:
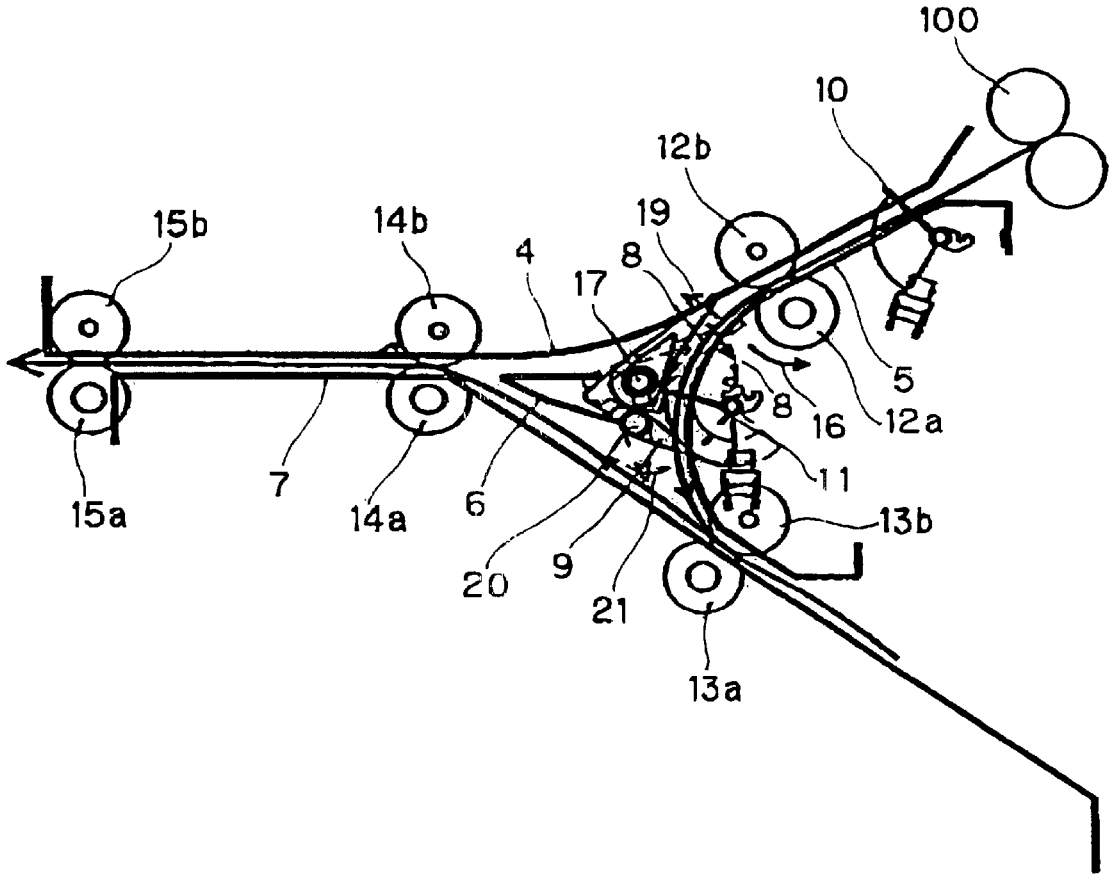
FIG. 4 is a partial sectional view of the sheet material conveying device in accordance with the first embodiment of the present invention.

At this time, the switching flapper 8 is in the state of a solid line in FIG. 4 and is positioned so as to overlap the conveyance guide plate 4.

Another pamphlet is discharged from the pair of rollers 100 for discharging a pamphlet and drawn by the pair of drawing-in rollers 12 which rotates in the arrow 16 direction.

Then, the pamphlet P is conveyed by the switching flapper 8 downstream of the roller pair 12 in a direction of the second conveying path.

Thereafter, when it is detected that the tip end of the pamphlet P has entered the sensor flag 11 for detecting passage of a pamphlet, the not-shown solenoid of the switching flapper 8 is turned off. Then, the switching flapper 8 returns to the position of the initial state (see FIG. 5)

Here, the driving roller of the pair of drawing-in rollers 12 is positioned on the inner side, whereby the outside roller is driven as shown in FIG. 6. Thus, only a cover of the pamphlet P moves in a tangent direction by driving the roller. Therefore, it is possible to prevent conveyance jam due to the occurrence of the slack. FIG. 6 is a partial sectional view of a sheet material conveying device in accordance with a comparative example for explaining the sheet material conveying device in accordance with the first embodiment of the present invention.

Further, the nip line of the pair of drawing-in rollers 12 is made close to the conveyance guide plate 5 on the driving roller side.

Further, the pamphlet conveying speed is 75 mm/s, and the conveying time from the entrance into the inlet sensor flag 10 to the entrance into the switching flapper 8 is appropriately 1 s. Thus, in the case where the tip end of the pamphlet P does not pass the sensor flag 11 for detecting passage of a pamphlet due to jam in the vicinity of the pair of drawing-in rollers 12, the solenoid is previously controlled so as to be turned off in 2 s irrespective of on and off of the sensor flag 11 for detecting passage of a pamphlet with the purpose of protecting an overcurrent.

On the other hand, as shown in FIG. 4, the reversal preventing flapper 9 as the second switching means of the present invention is arranged downstream of the sensor flag 11 for detecting passage of a pamphlet. The flapper 9 is always pulled by a not-shown spring in an arrow 21 direction with a rotational axis 20 as the center, and is positioned so as to overlap the conveyance guide plate 5 as shown by the solid line in FIG. 4.

Figure 7:
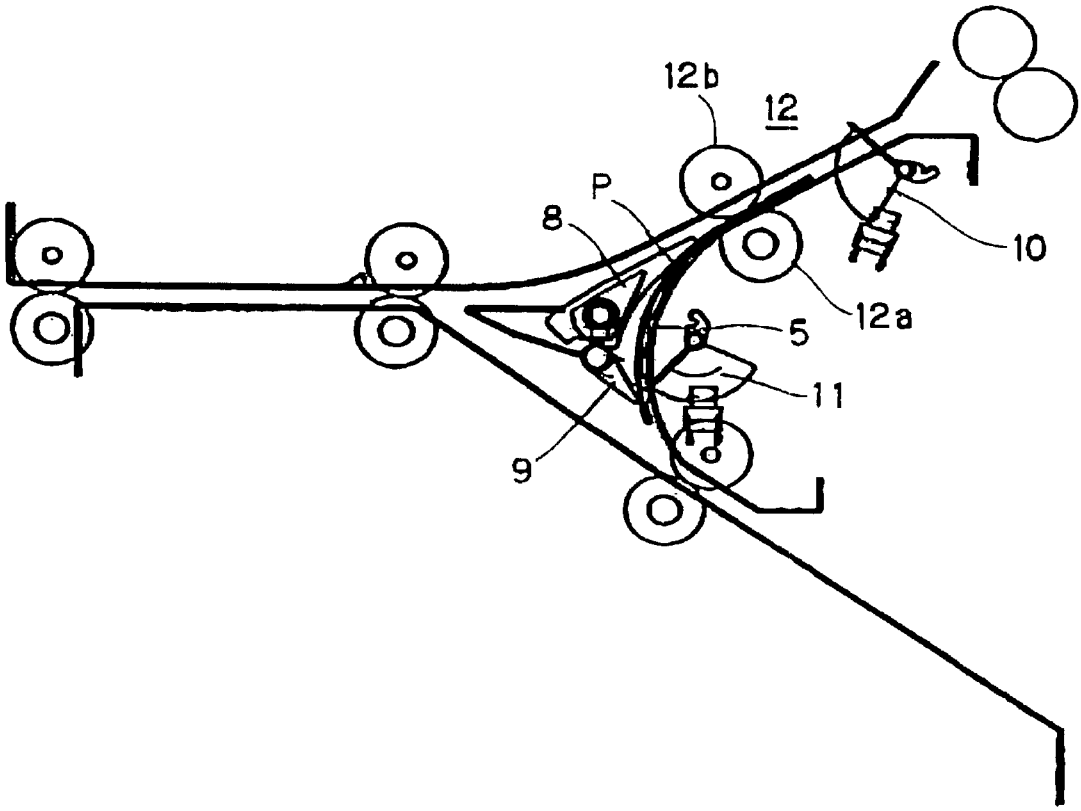
FIG. 7 is a partial sectional view of the sheet material conveying device in accordance with the first embodiment of the present invention.

The pamphlet P passes the reversal preventing flapper 9 while the tip end pushes the reversal preventing flapper 9 aside (see FIG. 7).

The pair of SB rollers 13 is arranged downstream of the reversal preventing flapper 9, and the pamphlet P is drawn by the pair of SB rollers 13 which rotates in an arrow 23 direction. Note that the pair of SB rollers 13 uses a not-shown stepping motor for driving. The pair of SB rollers 13 is normally in a stop state, and starts to rotate in the arrow 23 direction when the not-shown solenoid of the switching flapper 8 is pulled.

Figure 8:
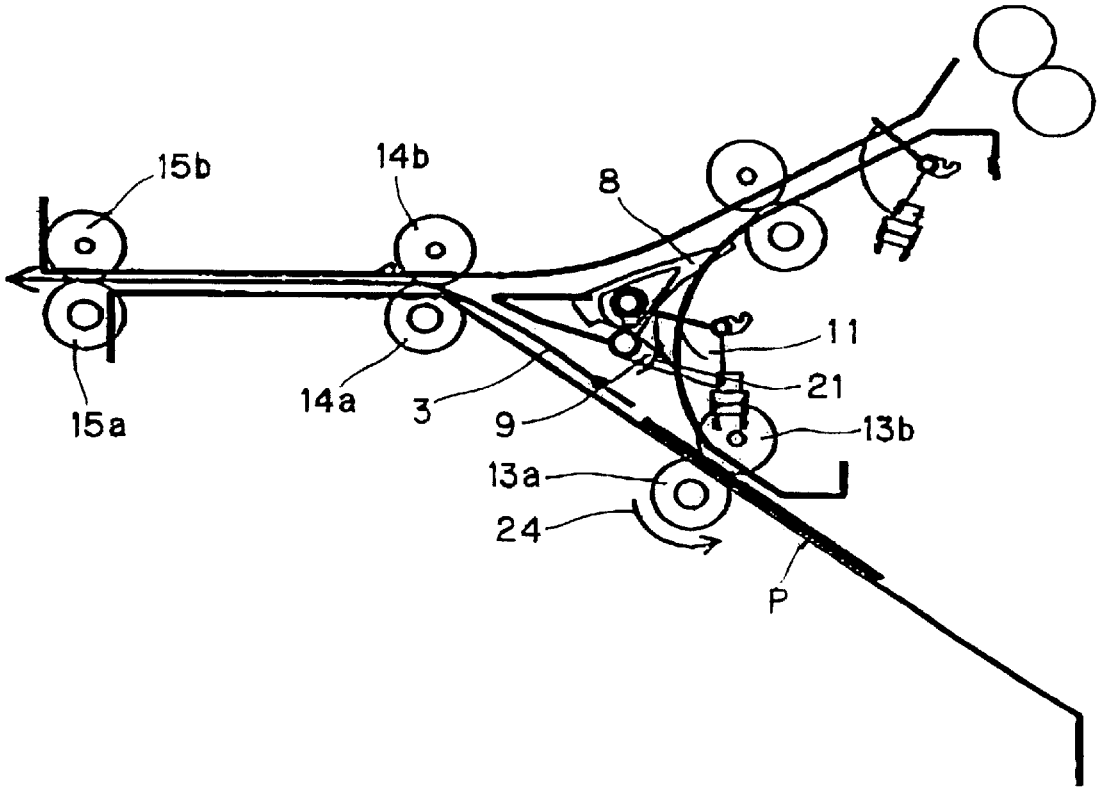
FIG. 8 is a partial sectional view of the sheet material conveying device in accordance with the first embodiment of the present invention.

Thereafter, as shown in FIG. 8, after a predetermined time elapses after a rear end of the pamphlet P drawn by the pair of SB rollers 13 passes the sensor flag 11 for detecting passage of a pamphlet, control is performed such that the pair of SB rollers 13 starts to rotate in an arrow 24 direction before the rear end of the pamphlet P passes a nip of the pair of SB rollers 13. Thus, the pamphlet P starts to be conveyed through the second conveying path 2 in an arrow 3 direction with the opposite side to the folded side of the pamphlet P as the leading end.

At this time, the reversal preventing flapper 9 is in the state shown in FIG. 8 by a not-shown spring, and rotates in the arrow 21 direction no more.

Therefore, in the case where the tip end portion of the pamphlet P moves abnormally before arriving the lower surface side of the conveyance guide plate 6, the reversal preventing flapper 9 prevents reversal of the pamphlet P and can guide the pamphlet P in the arrow 2 direction. Thus, reversal jam can be prevented from happening.

Thereafter, the pamphlet P is conveyed to the pair of conveying rollers 14 by the pair of SB rollers 13 and is discharged and stacked on a tray by the pair of discharge rollers 15.

Note that the combination of order of the straight discharge and reversal discharge described above can be changed in any way only by the control of the switching flapper 8.

Further, the reversal preventing flapper 9 has substantially the same action as the sensor flag 11 for detecting passage of a pamphlet with respect to the conveyance of the pamphlet P. Thus, it is possible to make the reversal preventing flapper 9 also have the role of the sensor flag 11 for detecting passage.

Figure 2:
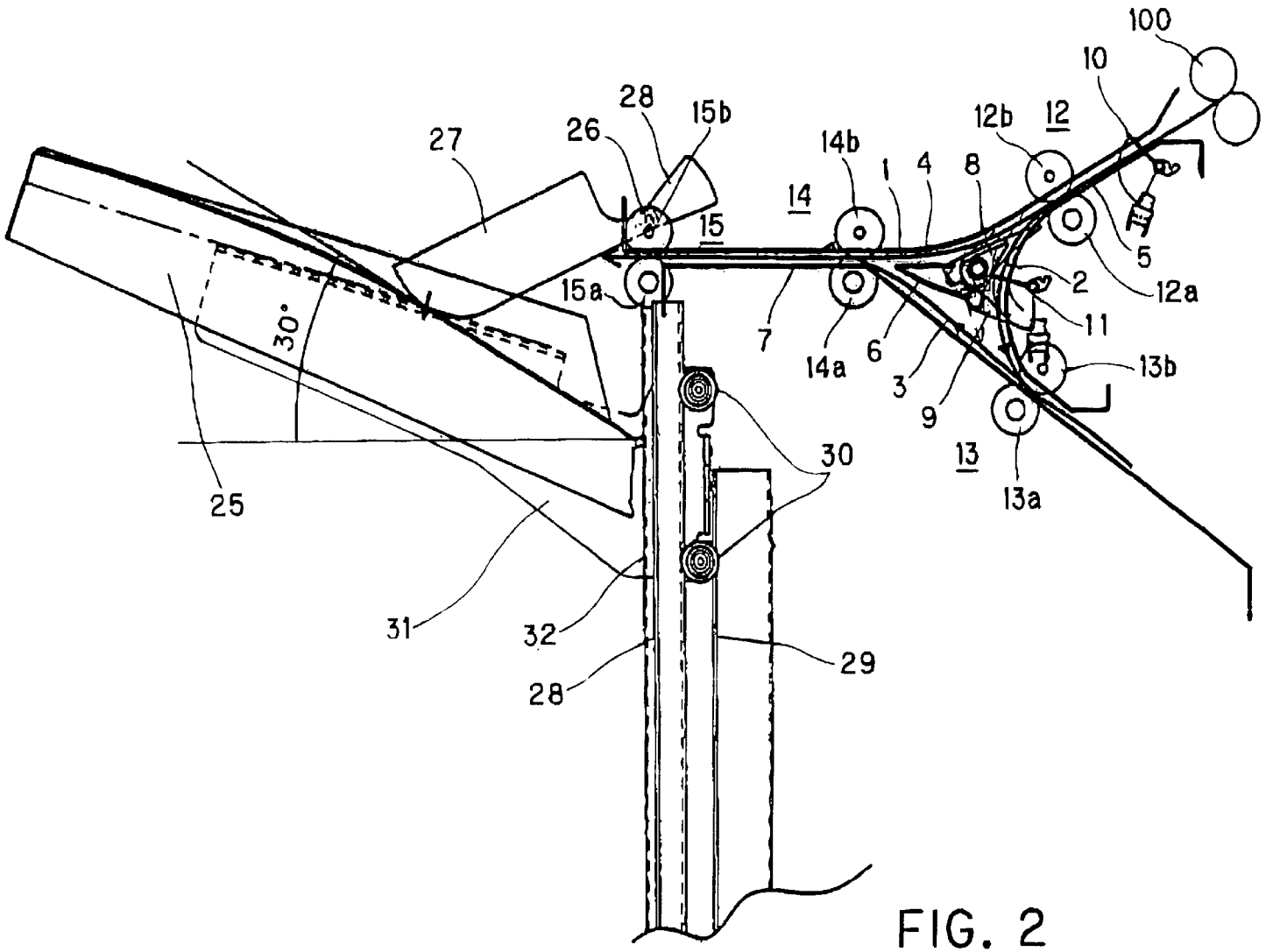
FIG. 2 is a partial sectional view of the sheet material conveying device in accordance with the first embodiment of the present invention.

Next, description is made of a stacking tray portion with reference to FIG. 2. As to a stacking tray 25 as a stacking means of the present invention, a pamphlet stacking surface desirably has an inclination angle in a range of −20 to 45 degrees with respect to a horizontal plane, and an angle of −30 degrees is the most suitable. Here, −X degree is an angle that is measured in a clockwise direction as shown in FIG. 2.

Further, a weight 27, which is rotatable around an axis 26 as the center, is in contact with the pamphlet stacking surface. The weight 27 also serves as a sensor flag portion 28.

The stacking tray 25 is regulated so as to move in a substantially vertical direction by a pair of elevating guides 29 and an elevating roller 30.

The elevating roller 30 is fixed with caulking to a tray fulcrum 31, and the stacking tray 25 is fixed to the tray fulcrum 31.

The tray fulcrum 31 is fixed to a not-shown timing belt. A not-shown pulley that is wound around by the timing belt is rotated by using a driving means, whereby the stacking tray 25 can be elevated.

Note that the tray fulcrum 31 on the front side is shown in FIG. 2. Another tray fulcrum that is substantially the same as the tray fulcrum 31 actually exists on the back side, but explanation thereof is omitted. Further, the elevating means of the stacking tray 25 is not particularly limited to the timing belt as long as the means enables the same action as that of the timing belt.

Figure 9:
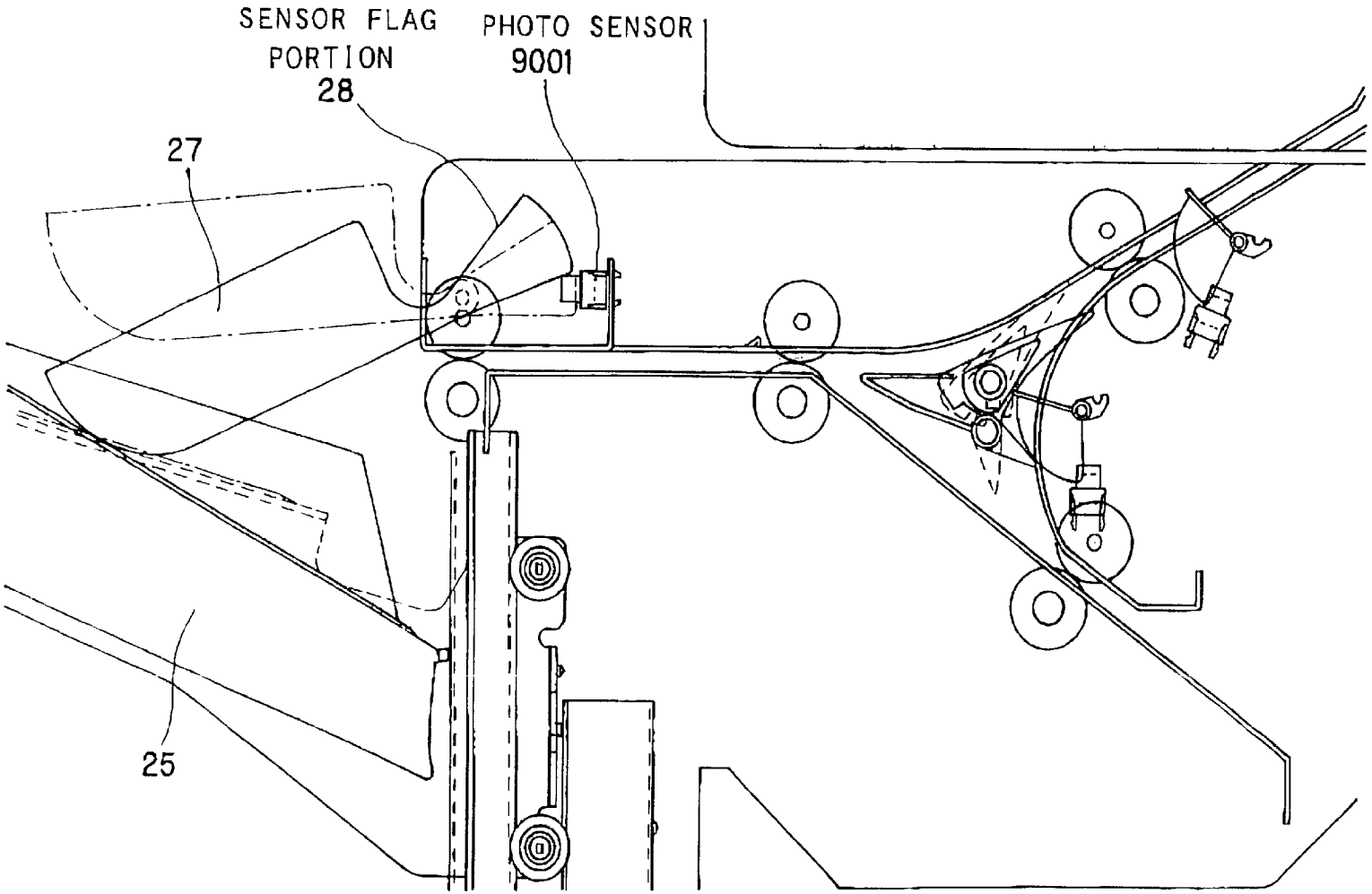
FIG. 9 is a partial sectional view of the sheet material conveying device in accordance with the first embodiment of the present invention.

Next, the action of the stacking tray 25 is explained with reference to FIG. 9. FIG. 9 is a partial sectional view of the sheet material conveying device in accordance with the first embodiment of the present invention.

The elevating position of the stacking tray 25 is controlled in accordance with a detection signal of the sensor flag portion 28 as a detecting means of the present invention which is provided in the weight 27.

First, in the initial operation at the time of turning a power supply on, the stacking tray 25 is moved to the optimum position.

There are two initial operation patterns, which are hereinafter referred to as patterns 1 and 2, respectively.

(Pattern 1)

In the case where the stacking tray 25 (stacking surface) is positioned below the predetermined position, and the sensor flag portion 28 functioning as a light shielding means of the present invention does not shield a photo sensor 9001 as a light receiving means of the present invention against the light from a not-shown light emitting means such as an LED, the stacking tray 25 is lifted so as to shield the photo sensor 9001 against the light and is stopped once. Then, control is conducted in which the stacking tray 25 is lowered such that the photo sensor 9001 is transmitted with the light by the sensor flag portion 28, and the stacking tray 25 is stopped at the optimum position.

(Pattern 2)

In the case where the stacking tray 25 (stacking surface) is positioned above the predetermined position, and the sensor flag portion 28 shields the photo sensor 9001 against light, control is performed in which the stacking tray 25 is lowered such that the photo sensor 9001 is transmitted with light, and the stacking tray 25 is stopped at the optimum position.

Next, explanation is made of the case where the pamphlet P is stacked on the stacking tray 25. The power supply is turned on, it is confirmed that the stacking tray 25 is returned to the initial position, and stacking of the pamphlet P becomes possible. Then, this is transmitted to the sheet post-processing device, and a discharge of the pamphlet P is started.

The time for the pamphlet P to pass the inlet sensor flag 10 for detecting the tip end of the pamphlet P is measured, thereby judging the size of the pamphlet. When the pamphlet P passes the conveying path to be discharged onto the stacking tray 25 by the pair of discharge rollers 15, the tip end of the pamphlet P pushes the weight 27, which blocks up the front side of the pair of discharge rollers 15, aside, and the sensor flag portion 28 shields the photo sensor 9001 against light, whereby it is confirmed first that the pamphlet P has arrived at the stacking tray 25.

Thereafter, by calculating the time when the pamphlet P is completely discharged on the stacking tray 25 based on the measured pamphlet size, it is confirmed that the pamphlet p is completely discharged onto the stacking tray 25 irrespective of chattering of the sensor flag portion 28.

Further, control, in which the uppermost pamphlet stacking surface of the stacking tray 25 is kept at a fixed position immediately after the pamphlet P is discharged, can be conducted with either the pattern 1 or the pattern 2.

As to the stacking tray 25, the uppermost pamphlet stacking surface is moved to the fixed position every time one pamphlet P is discharged. When it is confirmed the above operation is completed, there is obtained the state in which the next pamphlet can be stacked on the stacking tray 25.

Further, in the case where the weight 27 is not pushed aside when a pamphlet such as a thin pamphlet or a pamphlet that tears easily is discharged onto the stacking tray 25, it cannot be confirmed by the sensor flag portion 28 that the pamphlet P is discharged onto the stacking tray 25.

Therefore, the time for the pamphlet to pass the conveying path is previously measured, and also in the case where the sensor flag portion 28 does not make a reaction, control is made such that the stacking tray 25 is certainly elevated after a predetermined time elapses after the pamphlet enters the inlet sensor flag 10. Thus, there is obtained the state in which the next pamphlet P can be stacked.

Further, a not-shown sensor for detecting passage of the rear end of the pamphlet P in the vicinity of the pair of discharge rollers 15 in discharging the pamphlet P to the stacking tray 25 is provided in the first conveying path 1 in the vicinity of the pair of discharge rollers 15 and separately from the sensor flag portion 28 that is provided in the weight 27, whereby the above control can be omitted.

When the pamphlet P is discharged and stacked onto the stacking tray 25, the pamphlet slips down to a rear end abutting wall 32 in FIG. 2 by its own weight due to inclination of the stacking surface. Thus, stacking matching property on the stacking tray 25 is excellent.

Further, since the uppermost surface of the pamphlet stacked on the stacking tray 25 is always pressed down by the weight 27, opening of the pamphlet can be prevented.

Figure 10:
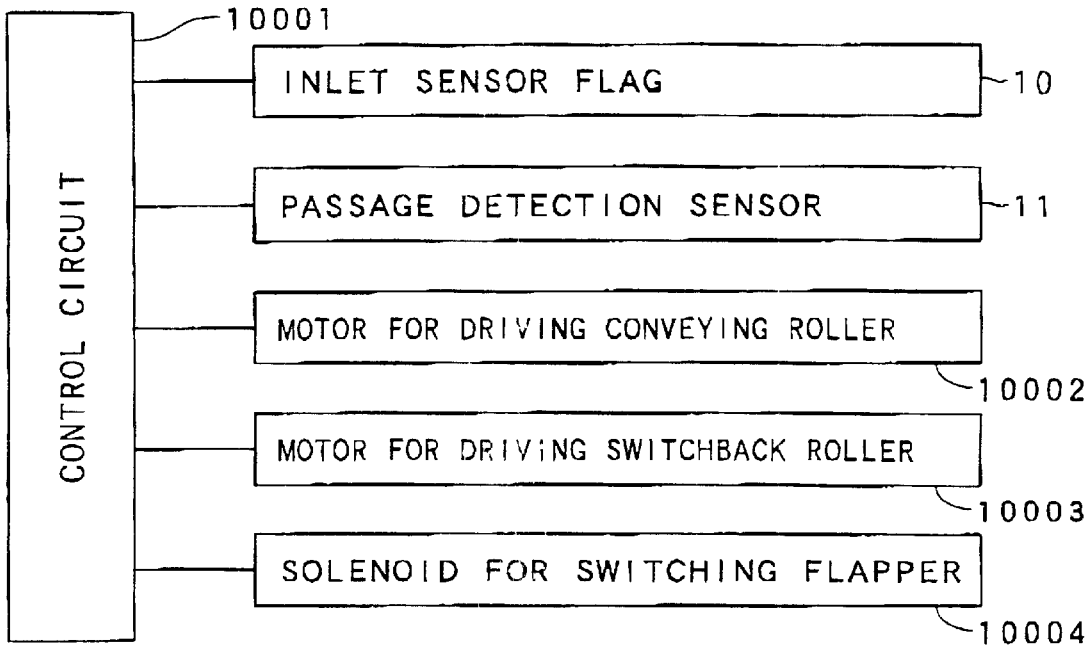
FIG. 10 is a block diagram of a control circuit provided to the sheet material conveying device in accordance with the first embodiment of the present invention.

Next, a control circuit provided to the sheet material conveying device in accordance with the first embodiment of the present invention is described with reference to FIG. 10. FIG. 10 is a block diagram of the control circuit provided to the sheet material conveying device in accordance with the first embodiment of the present invention.

A control circuit 10001 shown in FIG. 10 is a control circuit for controlling the entire operation of the sheet material conveying device.

The control circuit 10001 controls, for example, a motor for driving the pair of drawing-in rollers 12, the pair of switchback rollers 13, the pair of conveying rollers 14, the pair of discharge rollers 15, or the like and a solenoid for switching the switching flapper 8, the reversal preventing flapper 9, or the like.

For example, as shown in FIG. 10, the control circuit 10001 controls the inlet sensor flag 10, the sensor flag 11 for detecting passage, a motor 10002 for driving a conveying roller, a switchback driving motor 10003, and a solenoid 10004 for a switching flapper.

Incidentally, the control circuit 10001 shown in FIG. 10 does not control only the members in FIG. 10, and may control respective members provided in the sheet material conveying device in this embodiment or the sheet material conveying device in each of the embodiments described below.

Figure 12:
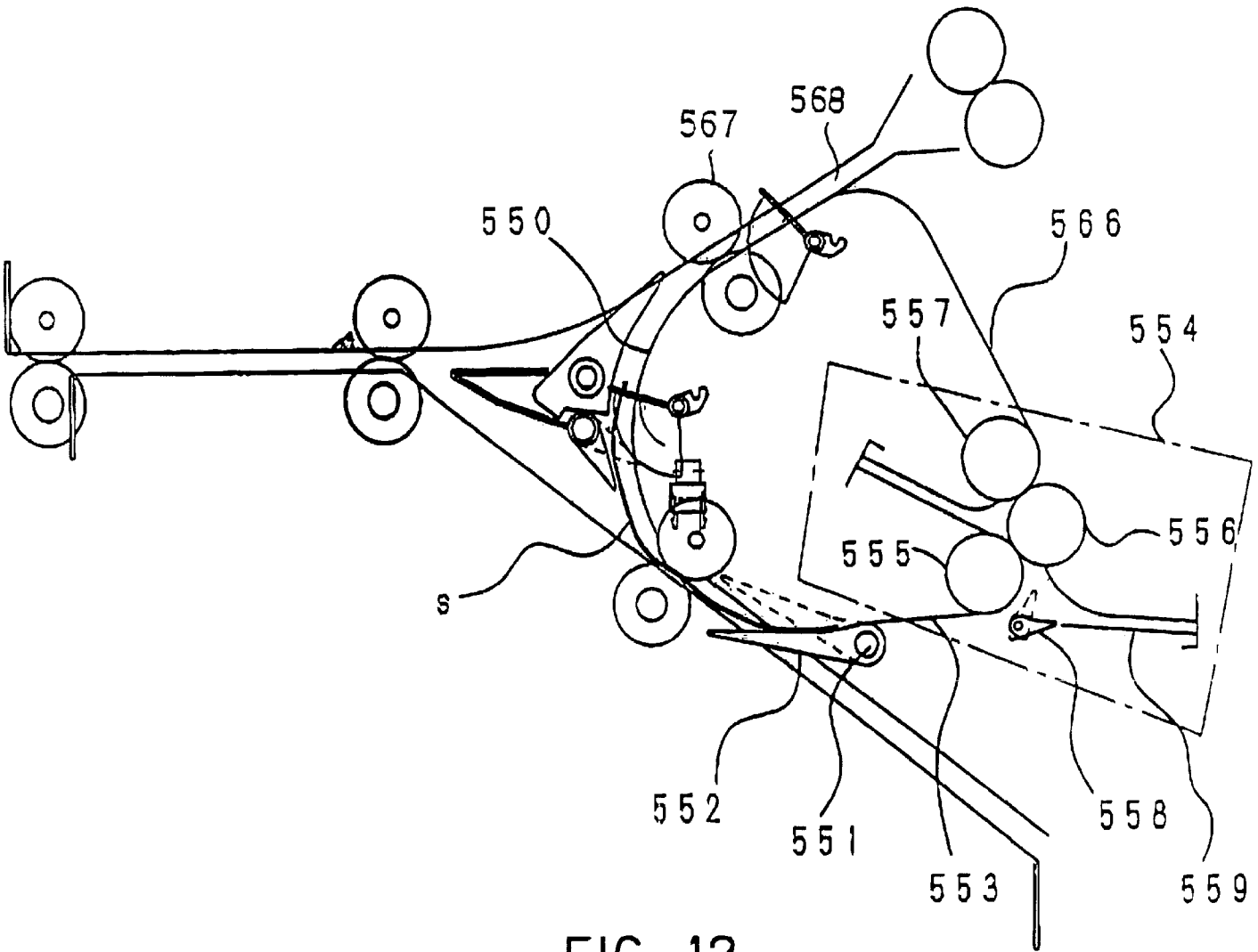
FIG. 12 is a partial sectional view of a sheet material conveying device in accordance with a third embodiment of the present invention.

For example, the operations of folding rollers 555, 556, and 557 and the like, which are described below and shown in FIG. 12, are controlled by the control circuit 10001 shown in FIG. 10.

As described above, in accordance with the sheet material conveying device of the first embodiment of the present invention, even in the case where the folded sheet material is used for the pamphlet P, the pamphlet P can be discharged onto the stacking tray 25 in an appropriate stacking state since the pamphlet P is appropriately inverted by the first conveying path 1, the second conveying path 2, and the third conveying path 3 to be discharged to the stacking tray 25.

Further, the height of the stacking surface of the sheet material or pamphlet on the stacking tray 25 is detected by the sensor flag portion 28, there by being capable of varying the height of the stacking tray 25. Thus, stacking property can be further improved.

(Second Embodiment)

Figure 11:
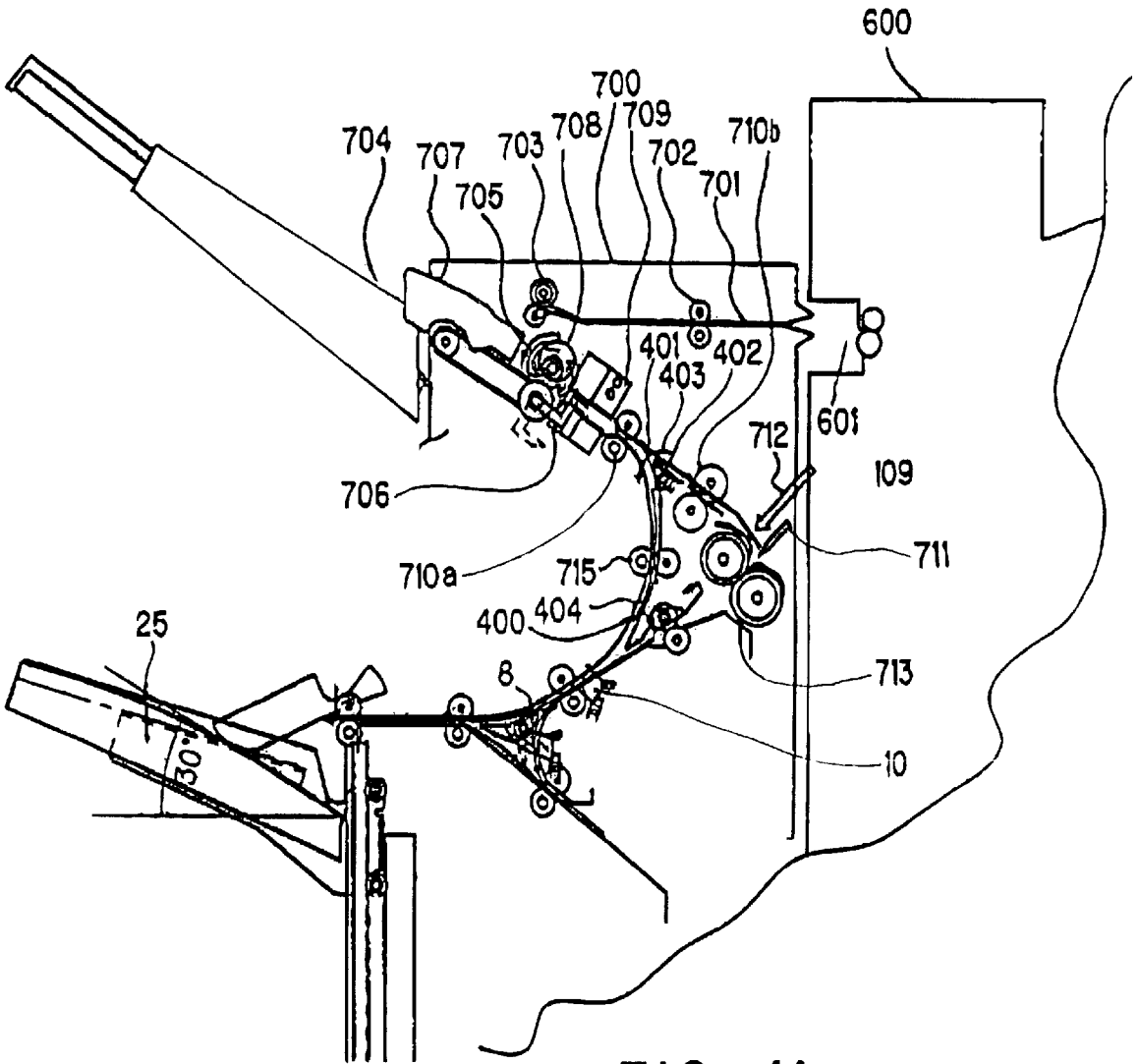
FIG. 11 is a partial sectional view of a sheet material conveying device in accordance with a second embodiment of the present invention.

Next, a sheet material conveying device in accordance with a second embodiment of the present invention will be described in detail with reference to the accompanying drawing. FIG. 11 is a partial sectional view of the sheet material conveying device in accordance with the second embodiment of the present invention.

A structure of a fifth conveying path 400 is the part that differs between the sheet material conveying device in accordance with the second embodiment of the present invention and the sheet material conveying device in accordance with the first embodiment. Other portions are substantially the same between the first and second embodiments, and thus, detailed explanation thereof is omitted.

First, explanation will hereinafter be made of the sheet post-processing device that is positioned upstream of the not-shown pair of rollers 100 for discharging a pamphlet in the second embodiment with reference to FIG. 11.

(Description of Entire Structure)

The entire structure of the sheet material conveying device in accordance with the second embodiment of the present invention is shown in FIG. 11 with the sheet post-processing device as the primary part. Reference numeral 600 denotes the image forming apparatus, and reference numeral 700 denotes the sheet post-processing device. Note that the sheet material conveying device in this embodiment is formed integrally with the sheet post-processing device 700. That is, it may be recognized that the sheet material conveying device in this embodiment is the sheet post-processing device 700.

The sheet post-processing device 700 is installed such that a not-shown sheet material S can be conveyed thereto from the face-up discharge portion 601 of the image forming apparatus 600. The connected state between the image forming apparatus 600 and the sheet post-processing device 700 is always monitored by a not-shown communication means.

When the image forming apparatus 600 and the sheet post-processing device 700 are not connected with each other, this is displayed on a display portion of the image forming apparatus 600, and information on this is sent to a computer connected thereto.

When the sheet post-processing device 700 is connected with the image forming apparatus 600, and a print job gives an instruction on an output of the sheet post-processing device 700, a pamphlet is discharged from the face-up discharge portion 601 of the image forming apparatus 600 to the sheet post-processing device 700.

Thereafter, the pamphlet is conveyed to an inlet roller 702 of the sheet post-processing device 700 by an inlet guide 701 of the sheet post-processing device 700.

The pamphlet is conveyed to a discharge roller 703 downstream of the inlet roller 702 by the inlet roller 702, and is discharged to an intermediate stacking portion 704 by the discharge roller 703. The pamphlet discharged to the intermediate stacking portion 704 is drawn by a drawing-in paddle 705 in the right direction in the figure.

Reference numeral 706 denotes a shutter, and a drawn bundle of sheets is matched in a sheet conveying direction by being abutted against the shutter 706.

Reference numeral 707 denotes a jogger means, which is movable to both sides in a sheet width direction of a pamphlet (between the front side and the back side in the figure) and conducts matching in the sheet width direction of a pamphlet. Reference numeral 708 denotes a bundle conveying roller that can be in press-contact with and be separatable to a bundle.

When the matching of the bundle of sheets is completed in the intermediate stacking portion 704, the shutter 706 rotates in a clockwise direction to retreat to the position of a dotted line in the figure. At the same time, the bundle discharge roller 708 is in press-contact with the bundle to convey the bundle of sheets to the downstream side.

When the intermediate point of the bundle of sheets reaches the binding position of a stapling unit 709, the conveyance of the bundle is stopped. Then, a saddle stitch of the bundle of sheets is conducted.

When the saddle stitch is completed, the bundle of sheets is further conveyed to the downstream side by a first pair of bundle conveying rollers 710*a*, which is constituted by two rollers, and a second pair of bundle conveying rollers 710*b*, which is constituted by two rollers, and is stopped at the position where the middle of the bundle of sheets is conveyed to a sliced veneer 711.

The bundle of sheets is pushed by the sliced veneer 711 in an arrow 712 direction. Thus, the bundle of sheets is sandwiched in a pair of folding rollers 713 while being folded at the central portion in the conveying direction. By the rotation of the pair of folding rollers 713, the bundle of sheets folded in half (hereinafter referred to as pamphlet) is discharged to the downstream side by the pair of rollers 100 for discharging a pamphlet. The conveying path for a pamphlet from the intermediate stacking portion 704 to the pair of folding rollers 713 is a fourth conveying path of the present invention.

Next, explanation is made of the fifth conveying path 400. The fifth conveying path 400 branches out from the conveying path between the first pair of bundle conveying rollers 710*a* and the second pair of bundle conveying rollers 710*b* and joins the upstream portion of the inlet sensor flag 10 of the first conveying path 1.

Further, a switching flapper 401 as a third switching means of the present invention is provided at the branching point, and is rotatably driven around an axis 402 as the center by a not-shown solenoid. The switching flapper 401 is normally located at the position of the solid line in the figure by a not-shown spring, and is driven to rotate in an arrow 403 direction by the not-shown solenoid.

In the case where a pamphlet needs to be formed, the switching flapper 401 is rotated in the arrow 403 direction, whereby the bundle of sheets is conveyed to the pair of folding rollers 713 to form the pamphlet. The pamphlet is discharged to the first conveying path 1 by the pair of rollers 100 for discharging a pamphlet with the folded side as the leading end.

However, when a sheet material S, which does not need to be formed into a pamphlet and does not require a folding process, a pamphlet that is a bundle of sheets stapled at the end portion, or the like is discharged and stacked onto the stacking tray 25, the not-shown solenoid is turned off, and the switching flapper 401 is returned to-the position of the solid line in the figure by the not-shown spring. Then, the sheet material S, the pamphlet, or the like is conveyed through the fifth conveying path 400 in an arrow 404 direction by using the first pair of bundle conveying rollers 710*a* and a third pair of bundle conveying rollers 715, and is guided to the first conveying path 1 not through the pair of folding rollers 713.

As described above, in the sheet material conveying device in accordance with the second embodiment of the present invention, the fifth conveying path 400 is provided. As a result, the normal sheet material S or the bundle of sheets subjected to stapling processing at the end portion, which is discharged from the sheet post-processing device 700, can also be discharged onto the stacking tray 25.

Further, particularly as to the bundle of sheets subjected to stapling processing at the end portion, there can be attained the same effect as in the first embodiment described above, that is, job separation in which the bundle is discharged onto the stacking tray 25 with the stapled position as the leading end or the rear end in the discharge direction by selectively switching the switching flapper 8 through the inversion structure portion shown in the first embodiment. Moreover, the sheet material S can also be passed through the inversion path, of course.

(Third Embodiment)

Figure 13A:
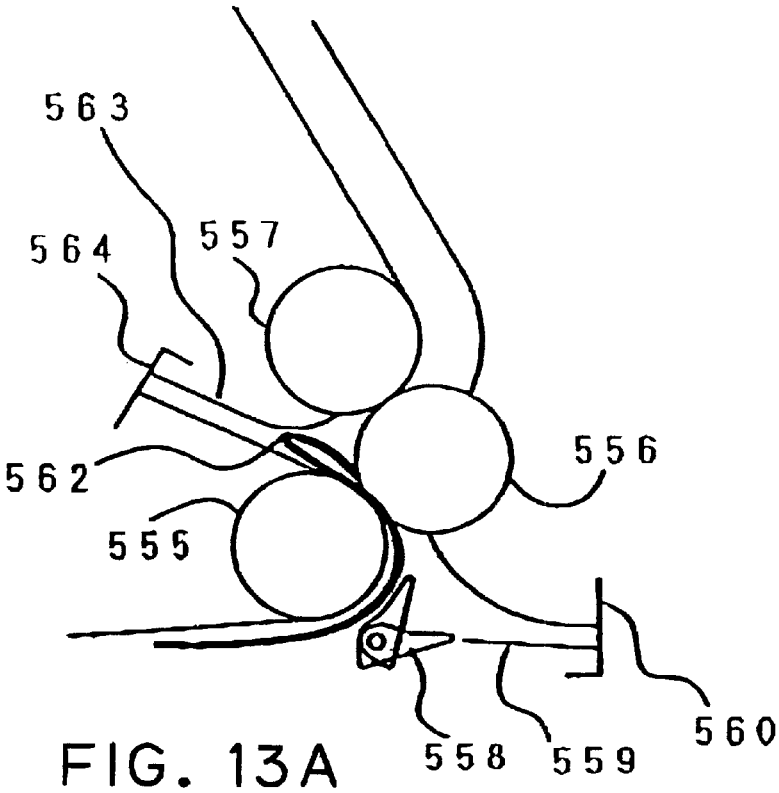
FIGS. 13A and 13B are partial sectional views of the sheet material conveying device in accordance with the third embodiment of the present invention.
Figure 13B:
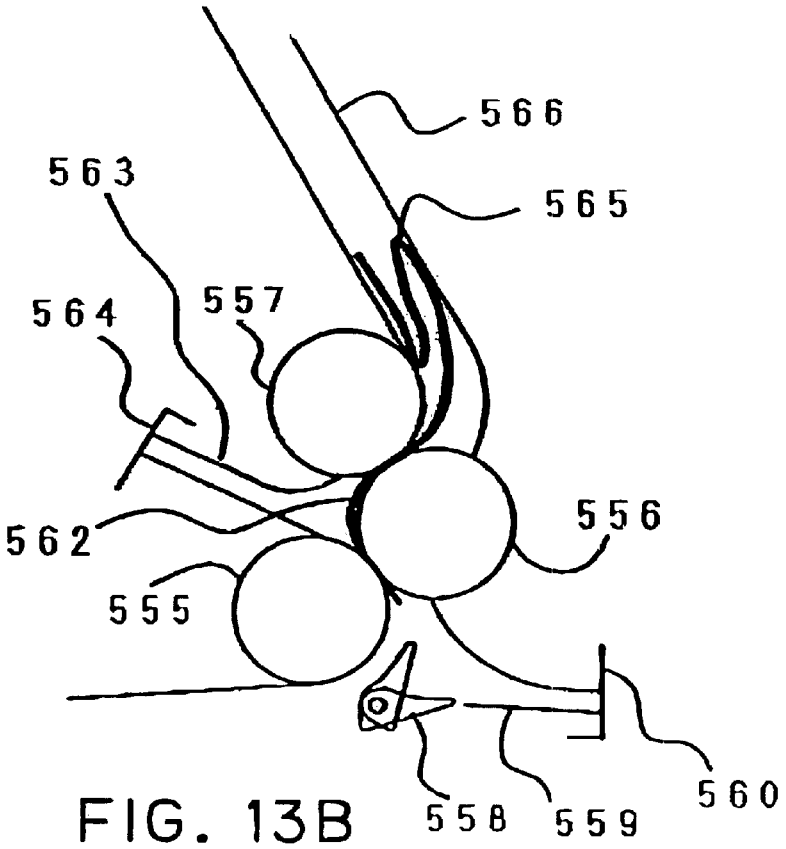

Next, a sheet material conveying device in accordance with a third embodiment of the present invention will be explained in detail with reference to FIGS. 12, 13A and 13B. FIGS. 12, 13A and 13B each show a partial sectional view of the sheet material conveying device in accordance with the third embodiment of the present invention. Note that, in this embodiment, description is mainly made of a different part from that in the sheet material conveying device in accordance with the first embodiment of the present invention.

As shown in FIG. 12, in this embodiment, a second branching point 551 and a flapper 552 as a fourth switching means are provided downstream of a second conveying path 550.

When the flapper 552 is positioned in accordance with a solid line in the figure, the sheet material S is guided to a sixth conveying path 553, and is conveyed to a folding unit (Z-folding unit) 554 as a processing means of the present invention.

The folding unit 554 is constituted by three folding rollers 555, 556, and 557. The operation of the folding rollers 555, 556, and 557 is controlled by the control circuit 10001 shown in FIG. 10.

The folding unit 554 can perform C-folding and Z-folding. Here, a Z-folding mode is explained with reference to FIGS. 13A and 13B.

The Z-folding mode is a mode in which a sheet material S is folded into two, and then, one of the two parts is folded back again to the opposite side. The sheet material S conveyed to the sixth conveying path 553 is first conveyed to a path 559, and the tip end of the sheet material S abuts with a stopper 560.

Thus, a loop is formed at a quarter portion from the tip end of the sheet material S. The loop is held by a nip formed by the folding rollers 555 and 556, a first crease 562 is formed, and then, a twofold sheet is obtained (FIG. 13A).

Next, the sheet material S folded as described above is guided to a folding path 563. When the first crease 562 of the twofold sheet material S abuts against a stopper 564, a loop is formed at the central portion of the twofold sheet material S in the same manner as in the described action. The loop is held by a nip formed by the folding rollers 556 and 557, and then, a second crease 565 is formed (FIG. 13B).

The Z-folded sheet folded inside out passes a seventh conveying path 566 and joins an upstream path 568 of an inlet roller 567.

As described above, in this embodiment, the sheet material S conveyed to the second conveying path 550 is conveyed to the folding unit 554 by the sixth conveying path 553 branching out from the downstream side. The sheet material S is subjected to folding processing, and then is returned to the upstream path 568 upstream of the inlet roller 567. Thus, stacking of a sheet having been subjected to folding processing is realized in addition to the function in the first embodiment.

Note that, in this embodiment, the Z-folding unit is provided between the sixth conveying path 553 and the seventh conveying path 556, but the present invention is not limited to the Z-folding unit. It is of course possible that there is provided between both the conveying paths a unit having other process in a function, such as a C-folding unit, a puncher unit for conducting puncher processing, or a pasting processing unit for conducting pasting, which is different from the Z-folding unit.

Figure 14:
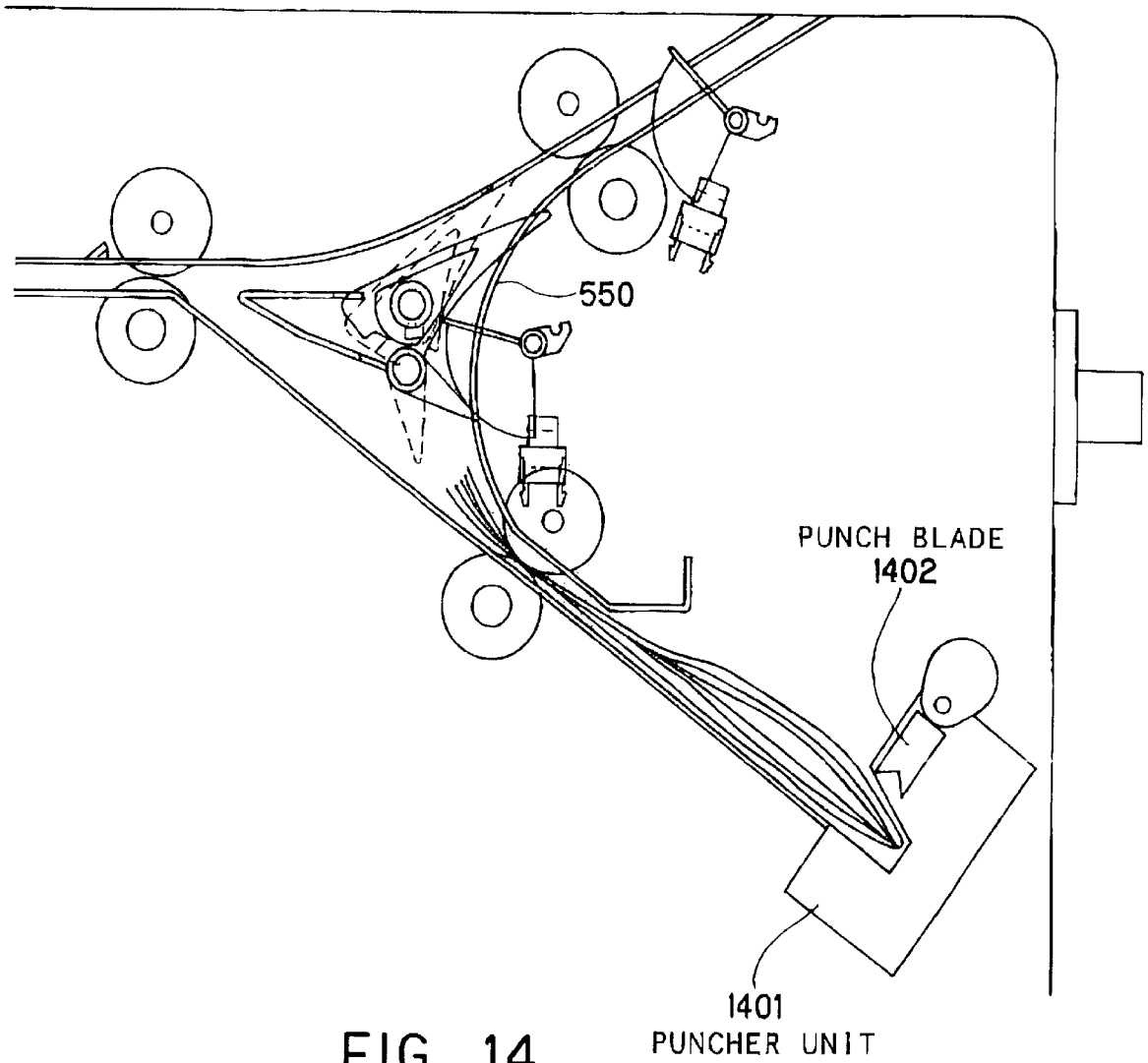
FIG. 14 is a partial sectional view of a modified example of the sheet material conveying device in accordance with the third embodiment of the present invention.

Explanation is made of the above-described puncher unit with reference to FIG. 14. FIG. 14 is a partial sectional view of a modified example of the sheet material conveying device in accordance with the third embodiment of the present invention.

As shown in FIG. 14, a puncher unit 1401 provided with a punch blade 1402 is arranged downstream of the second conveying path 550 in this embodiment.

Figure 15:
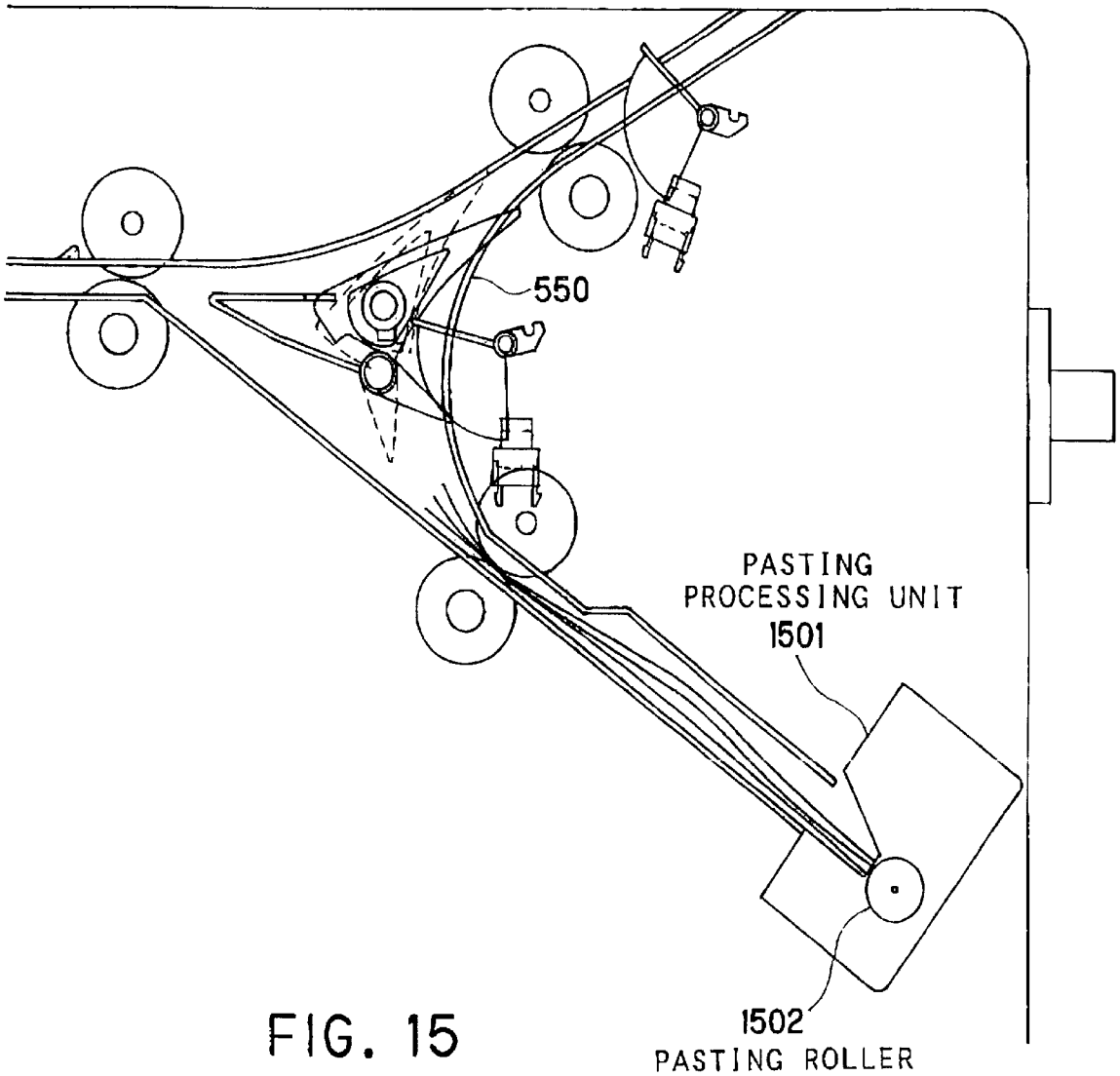
FIG. 15 is a partial sectional view of a modified example of the sheet material conveying device in accordance with the third embodiment of the present invention.

Further, the above-described pasting processing unit is described with reference to FIG. 15. FIG. 15 is a partial sectional view of a modified example of the sheet material conveying device in accordance with the third embodiment of the present invention.

As shown in FIG. 15, a pasting processing unit 1501 provided with a pasting roller 1502 is arranged downstream of the second conveying path 550 in this embodiment.

In the case where the sheet material conveying device shown in FIG. 14 or 15 is used, stacking of a sheet having been subjected to puncher processing or pasting processing can be realized in addition to the function in the first embodiment.

(Fourth Embodiment)

Figure 16:
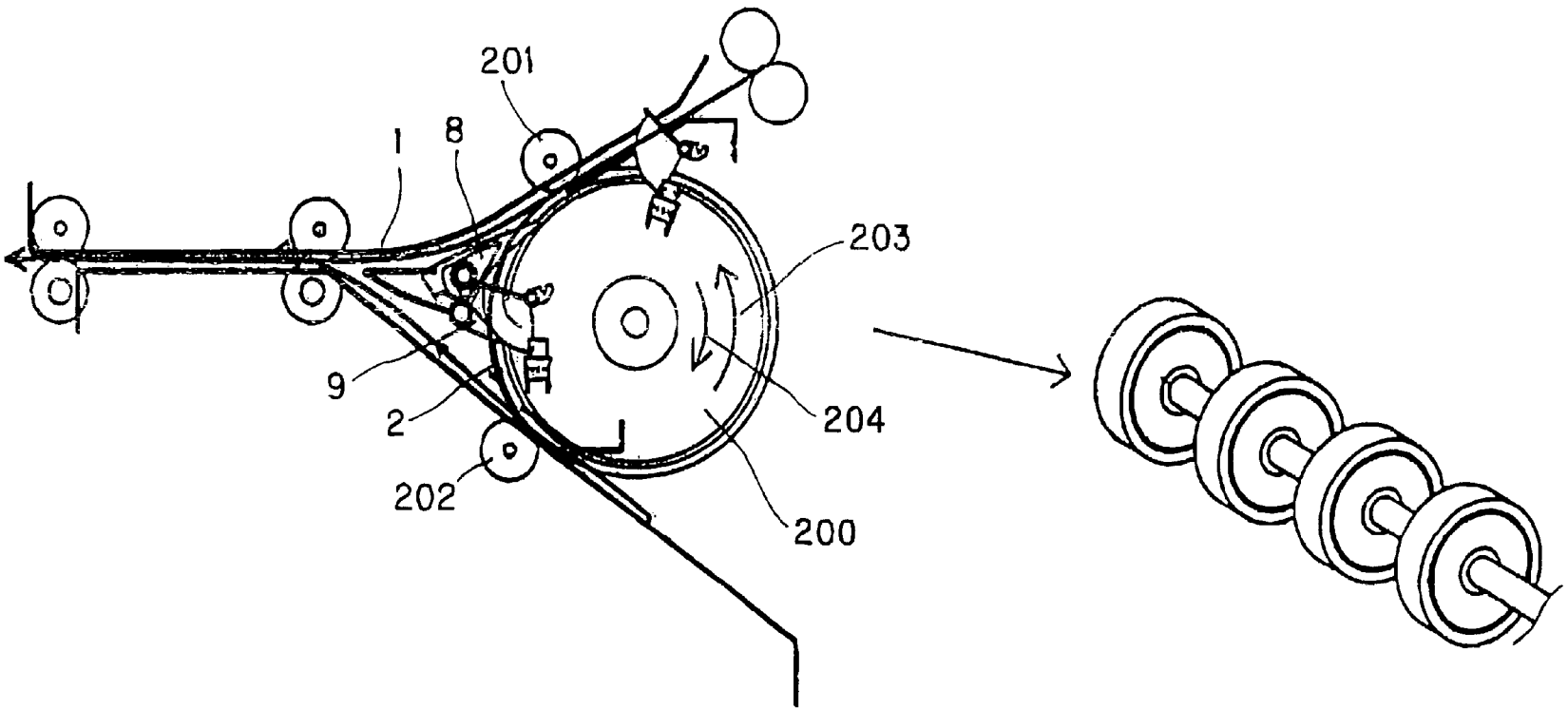
FIG. 16 is a partial sectional view of a sheet material conveying device in accordance with a fourth embodiment of the present invention.

Next, a sheet material conveying device in accordance with a fourth embodiment of the present invention will be described in detail with reference to FIG. 16. FIG. 16 is a partial sectional view of the sheet material conveying device in accordance with the fourth embodiment of the present invention. Note that, in this embodiment, description is mainly made of a different part from that in the sheet material conveying device in accordance with the above-described first embodiment.

A structure of a conveying roller in a curved conveying path is the part that differs between the sheet material conveying device in accordance with the fourth embodiment of the present invention and the sheet material conveying device in accordance with the first embodiment. Other portions are substantially the same between the first and fourth embodiments, and thus, detailed explanation thereof is omitted.

In FIG. 16, a large diameter roller 200 as a conveying roller of the present invention corresponds to one of a plurality of narrow rollers arranged on the same axis.

Reference numerals 201 and 202 each denote a driven roller that is in press-contact with the large diameter roller 200 by a not-shown elastic member. The large diameter roller 200 can be rotated in both normal and reverse directions by a not-shown stepping motor.

The circumference of the large diameter roller 200 has substantially the same curvature as the conveyance guide plate 5 in the first embodiment.

The large diameter roller 200 always rotates in an arrow 203 direction. In the case of a straight sheet discharge in an arrow 1 direction, a pamphlet P is drawn as in the first embodiment, and is discharged onto the stacking tray 25 shown in FIG. 2. Then, at the time of inversion of the pamphlet P, the switching flapper 8 is driven to rotate by the same control means as in the first embodiment, and the pamphlet P is guided to the second conveying path 2. That is, the large diameter roller 200 constitutes a wall of the second conveying path 2.

In the case where a sheet material or the pamphlet P is made to pass through the second conveying path 2, the sheet material or the pamphlet P can be conveyed while being in contact with the large diameter roller through the entire area of the curved conveying path. Thus, conveying property can be improved.

Thereafter, the rear end of the pamphlet P passes the sensor flag 11 for detecting passage of a pamphlet. After a predetermined time elapses, the large diameter roller 200 is reversely rotated in an arrow 204 direction. Thus, the pamphlet P is discharged with the opening side opposite to the folded side as the leading end.

Thereafter, when it is confirmed that the height of the tray stacking surface is returned to the initial state as in the first embodiment, the large diameter roller 200 starts to rotate again in the arrow 203 direction, and stacking is performed. From the above, in this embodiment, the same effect as in the first embodiment can be obtained, and more stable pamphlet conveyance and stacking can be realized in comparison with the first embodiment.

(Fifth Embodiment)

Figure 17B:
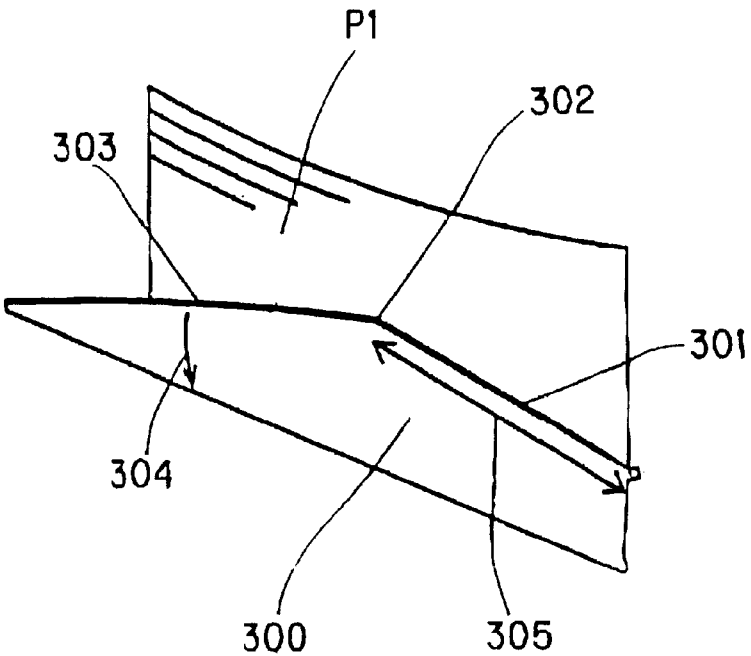
FIGS. 17A and 17B are a schematic diagram of a stacking tray provided to the sheet material conveying device in accordance with each of the first to fourth embodiments of the present invention and a schematic diagram of a stacking tray provided to a sheet material conveying device in accordance with a fifth embodiment of the present invention, respectively.
Figure 17A:
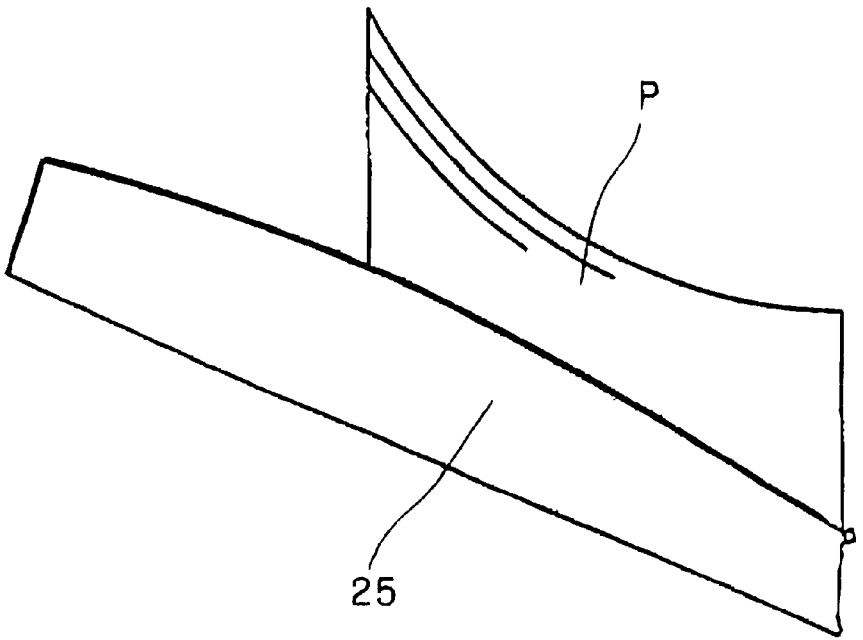

Next, a sheet material conveying device in accordance with a fifth embodiment of the present invention will be described in detail with reference to FIGS. 17A and 17B. FIG. 17B is a schematic diagram of a stacking tray provided to the sheet material conveying device in accordance with the fifth embodiment of the present invention.

A tray shape is the part that differs between the sheet material conveying device in accordance with the fifth embodiment of the present invention and the sheet material conveying device in accordance with any of the first to fourth embodiments. Other portions are substantially the same between the fifth embodiment and the first to fourth embodiments, and thus, detailed explanation thereof is omitted. FIG. 17A is a schematic diagram of the stacking tray 25 provided to the sheet material conveying device in accordance with each of the first to fourth embodiments of the present invention, and FIG. 17B is a schematic diagram of a stacking tray 300 provided to the sheet material conveying device in accordance with the fifth embodiment of the present invention.

The stacking tray 300 has a tray surface 301 and has the same angle as that of the stacking tray 25 in the first embodiment or the like. Further, the stacking tray 300 is formed with a tray surface 303 an angle of which is changed in an arrow 304 direction with respect to an angle of the tray surface 301 with an inflection point 302 as a boundary.

The inflection point 302 is positioned such that a distance 305 in the figure is in a range between the length in the conveying direction of the pamphlet size of a letter paper and below the length in the conveying direction of the pamphlet size of a ledger paper, namely, 139.5 mm to below 216 mm.

As described above, in this embodiment, the same effect as in the above-described embodiments can be obtained. At the same time, in the case where a pamphlet which has a large size and also tears easily is alternately stacked, a pamphlet P1 is stacked on the stacking tray 300, thereby keeping the uppermost pamphlet stacking surface substantially level, and thus, stacking property of the next pamphlet can be made stable more in comparison with the case where the pamphlet P is stacked on the stacking tray 25.

(Sixth Embodiment)

Figure 18:
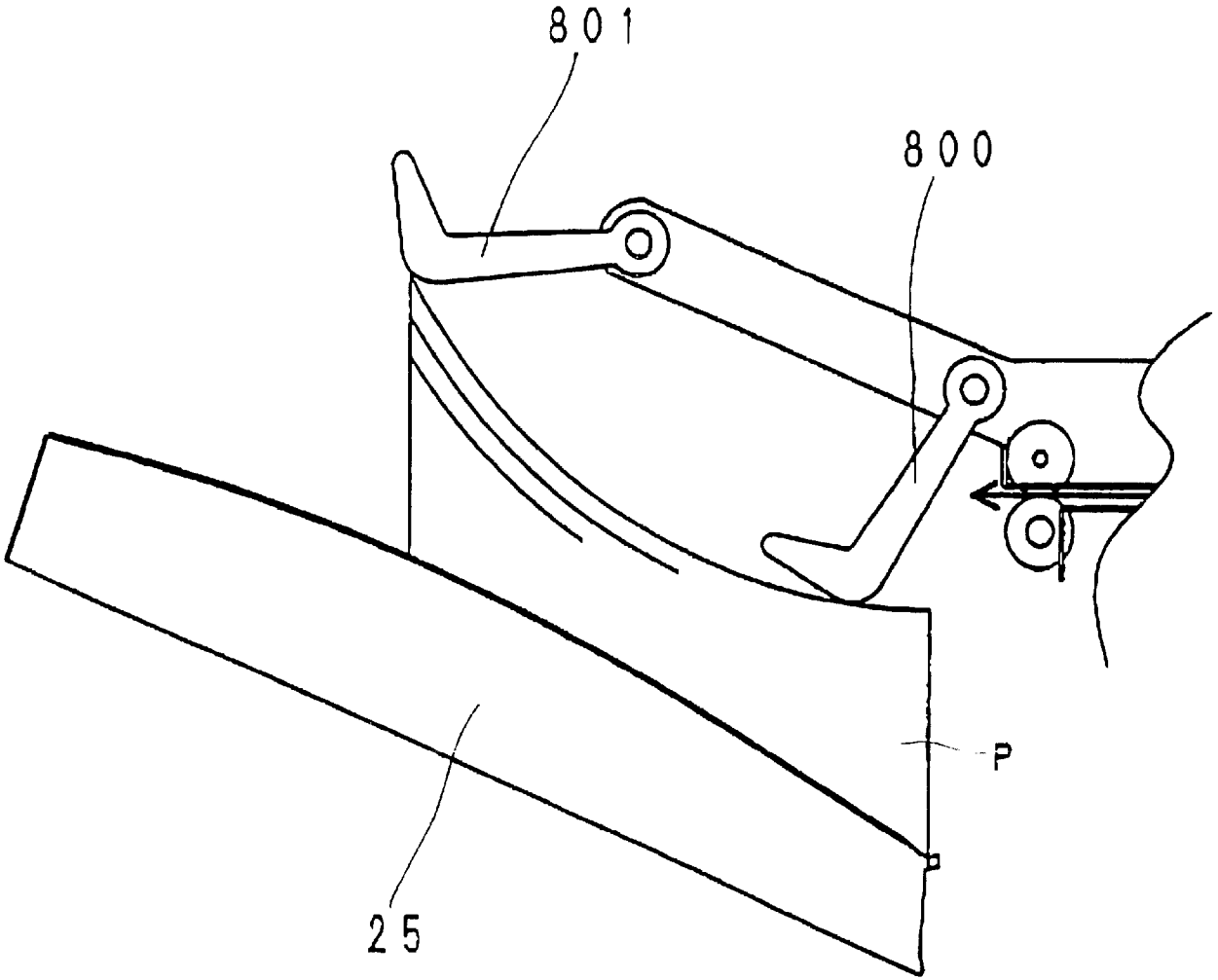
FIG. 18 is a schematic diagram of a sheet surface detection sensor provided to a sheet material conveying device in accordance with a sixth embodiment of the present invention.

Next, a sheet material conveying device in accordance with a sixth embodiment of the present invention will be described in detail with reference to FIG. 18. FIG. 18 is a schematic diagram of a sheet surface detection sensor provided to the sheet material conveying device in accordance with the sixth embodiment of the present invention.

A method of controlling pamphlet inversion is the part that differs between the sheet material conveying device in accordance with the sixth embodiment of the present invention and the sheet material conveying device in each of the above-described embodiments. Other portions are substantially the same between the sixth embodiment and the above-described embodiments, and thus, detailed explanation thereof is omitted.

FIG. 18 is a diagram partially showing the stacking tray 25 and the periphery thereof. Reference numeral 800 denotes a first sheet surface detection sensor flag as a first sensor flag constituting a sensor flag of the present invention. Reference numeral 801 denotes a second sheet surface detection sensor flag as a second sensor flag constituting a sensor flag of the present invention.

The two sensor flags each can measure the height of the uppermost surface of the pamphlet stacked on the stacking tray 25. After the pamphlet is discharged onto the stacking tray 25, the uppermost pamphlet stacking surface on the tray is returned to the initial position with a predetermined height by elevating the tray with the first sheet surface detection sensor flag 800. Thus, the tray height for stacking of the next pamphlet is determined. This is the same as in the above-described embodiments.

Next, it is measured by the second sheet surface detection sensor flag 801 whether or not the pamphlet on the uppermost pamphlet stacking surface is inclined by 30 degrees or more with respect to an inclination angle of 30 degrees of the tray stacking surface. That is, with the first sheet surface detection sensor flag 800 and the second sheet surface detection sensor flag 801, there is detected an angle formed by a straight line connecting at least two points on the upper surface of the sheet material or pamphlet on the stacking tray 25 and a horizontal plane.

As a result of this, it is determined whether the next pamphlet is invertedly discharged or straightly discharged. Discharge patterns 1 and 2 in this embodiment are described below.

(Discharge Pattern 1)

In the case where the inclination angle of the uppermost pamphlet stacking surface is sharper than the tray inclination angle of 30 degrees, the subsequent pamphlets are invertedly discharged until the inclination angle of the uppermost pamphlet stacking surface becomes slower than an angle of 30 degrees, and the pamphlet is discharged with the opening side as the leading end.

(Discharge Pattern 2)

In the case where the inclination angle of the uppermost pamphlet stacking surface is slower than the tray inclination angle of 30 degrees, the subsequent pamphlets are straightly discharged until the inclination angle of the uppermost pamphlet stacking surface becomes sharper than the angle of 30 degrees, and the pamphlet is discharged with the folded side as the leading end.

The above control is conducted, thereby selectively stacking the pamphlets in an alternative manner. This utilizes the fact that the folded side of the pamphlet has a swell in comparison with the opening side.

Incidentally, the angle of 30 degrees is given as a standard inclination angle in the above description, but the present invention is not limited to the inclination angle. Other angles may be adopted as appropriate values as long as they are in a range, for example, between 0° (the horizontal) and 90° (the vertical).

Therefore, the same effect as in the above-described embodiments can be obtained in this embodiment. At the same time, also in the case where the inclination angle of the uppermost pamphlet stacking surface is changed in accordance with a stacking condition, the inclination angle of the uppermost pamphlet stacking surface can be always kept at the vicinity of 30 degrees, namely, substantially the same as the inclination angle of the tray stacking surface. Thus, stable stacking is performed.

Further, the present invention is not necessarily limited to the sensor flag method shown in this embodiment as long as the inclination angle of the uppermost pamphlet stacking surface can be measured.

(Seventh Embodiment)

Figure 19:
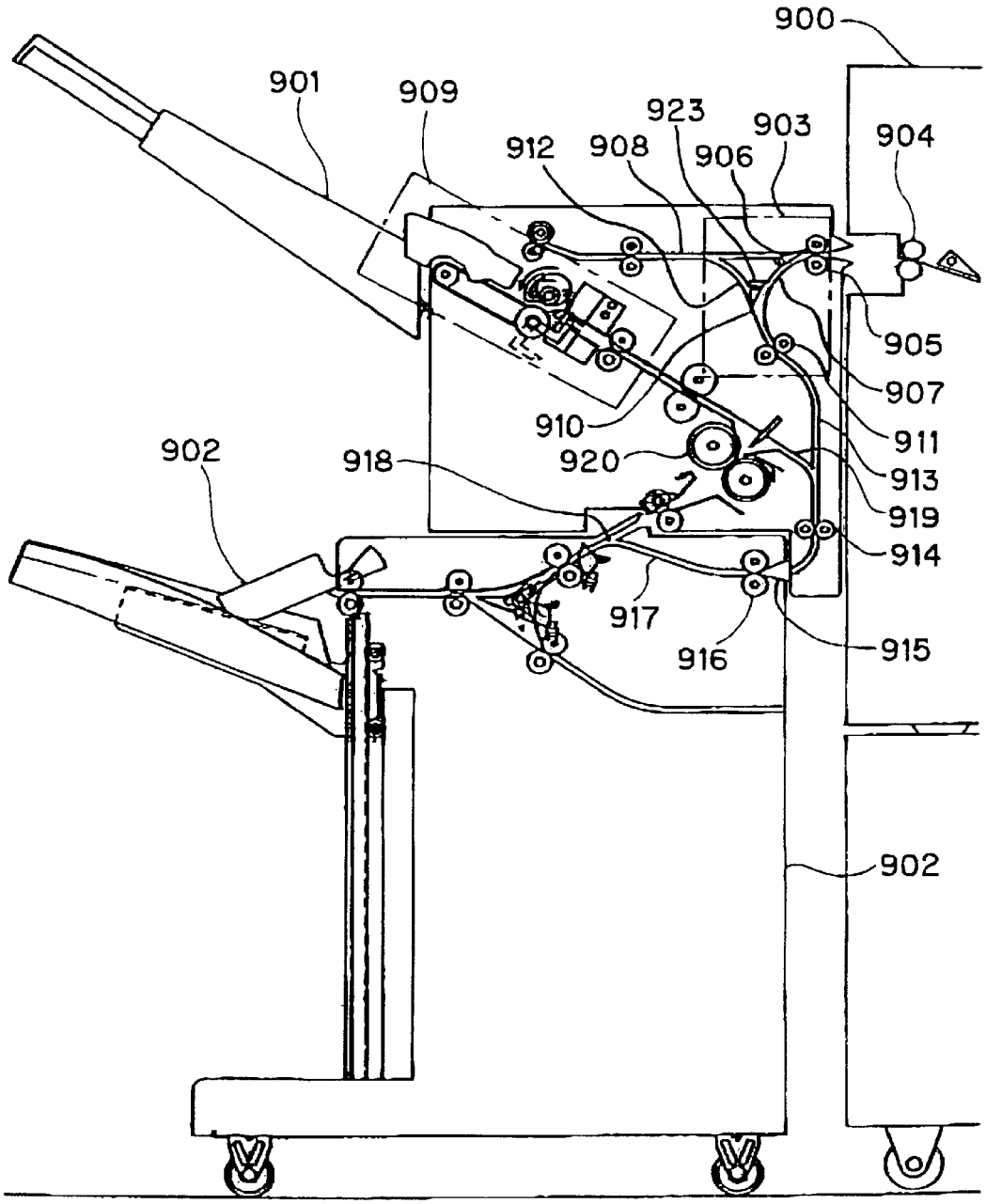
FIG. 19 is a sectional view of a sheet material conveying device in accordance with a seventh embodiment of the present invention.

Next, a sheet material conveying device in accordance with a seventh embodiment of the present invention will be described in detail with reference to FIG. 19. FIG. 19 is a sectional view of the sheet material conveying device in accordance with the seventh embodiment of the present invention. Note that, in this embodiment, description is mainly made of a different part from that in the first embodiment.

In FIG. 19, reference numeral 900 denotes an image forming apparatus, 901 denotes a sheet post-processing device being capable of conducting saddle-stitch processing to a sheet material received from the image forming apparatus 900, and 902 denotes a sheet conveying device. In this embodiment, the sheet post-processing device 901 and the sheet conveying device 902 constitute the sheet material conveying device of the present invention. Further, this embodiment has a characteristic that an inverting means 903 is additionally provided to the sheet post-processing device 901 in comparison with the other embodiments.

First, the sheet material discharged from a sheet discharge means 904 of the image forming apparatus 900 is conveyed to an inlet roller 905 of the inverting means 903 of the sheet post-processing device 901.

A flapper 906 as a fifth switching means of the present invention is provided downstream of the inlet roller 905, and thus, the sheet can be selectably conveyed to a straight path 908 as an eighth conveying path of the present invention and an inverting path 907 as a ninth conveying path of the present invention. The sheet conveyed to the straight path 908 is conveyed to a stapling processing portion 909 downstream of the straight path 908.

Further, a tenth conveying path 912 is provided between the inverting path 907 and the straight path 908.

The sheet conveyed to the inverting path 907 passes a confluence 910 provided with a flapper 923 as a sixth switching means of the present invention, a rear end of which consists of a flapper or the like, and then, is inverted by an inverting roller 911 that can rotate in normal and reverse directions. The sheet then passes through the path 912 to be conveyed to the stapling processing portion 909 as a stapling unit of the present invention.

Here, control is made in which the sheet is conveyed to the downstream side without rotating the inverting roller 911 in a reverse direction, whereby the sheet is conveyed to a longitudinal path 913 as an eleventh conveying path of the present invention for conveying a sheet to the downstream sheet conveying device 902.

The sheet conveyed to the longitudinal path 913 is conveyed to a second receiving port 915 of the sheet material conveying device by a downstream sheet discharge roller 914. The sheet then passes through a path 917 as a thirteenth conveying path of the present invention by an inlet roller 916 to be conveyed to a first receiving port 918.

As described above, in this embodiment, the same effect as in the above-described embodiments can be obtained. At the same time, although, for example, the sheet material conveying device can convey and stack only the sheet material having been subjected to saddle-stitch processing in the first embodiment, the following effect can be obtained in this embodiment. That is, by using the inverting means 903 provided in the inlet of the sheet post-processing device, the sheet is directly conveyed to the downstream sheet conveying device 902 with the use of the longitudinal path 913 without being passed through the stapling processing portion 909, whereby the sheet material or pamphlet can be stacked on the sheet conveying device 902 without a fall in throughput of the sheet material discharged from the image forming apparatus 900.

Further, by providing the path 917 constituting the thirteenth conveying path of the present invention which joins the longitudinal path 913 on the downstream side of the saddle-stitch folding portion, the sheet material having been subjected to stapling processing is made to pass a folding roller 920 to be conveyed to the longitudinal path 913. Thus, stitched original that has not undergone folding processing can be stacked not through the twelfth conveying path of the present invention which leads to the folding roller 920 constituting a folding processing means of the present invention via the stapling processing portion 909.

In each of the above-described embodiments, the sheet material conveying device may be freely detached/attached from/to the image forming apparatus or the post-processing device.

(Eighth Embodiment)

Figure 20:
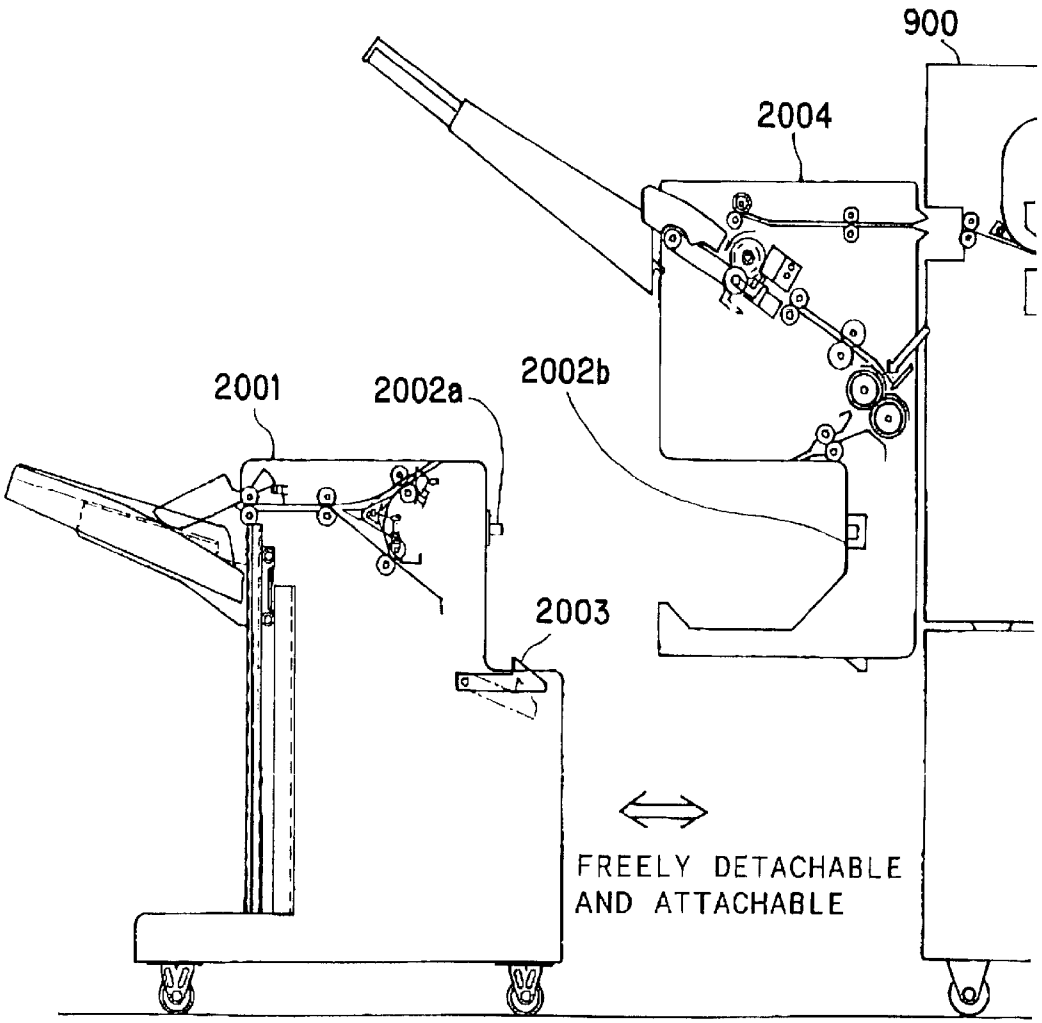
FIG. 20 is a sectional view of a sheet material conveying device in accordance with an eighth embodiment of the present invention.
Figure 21:
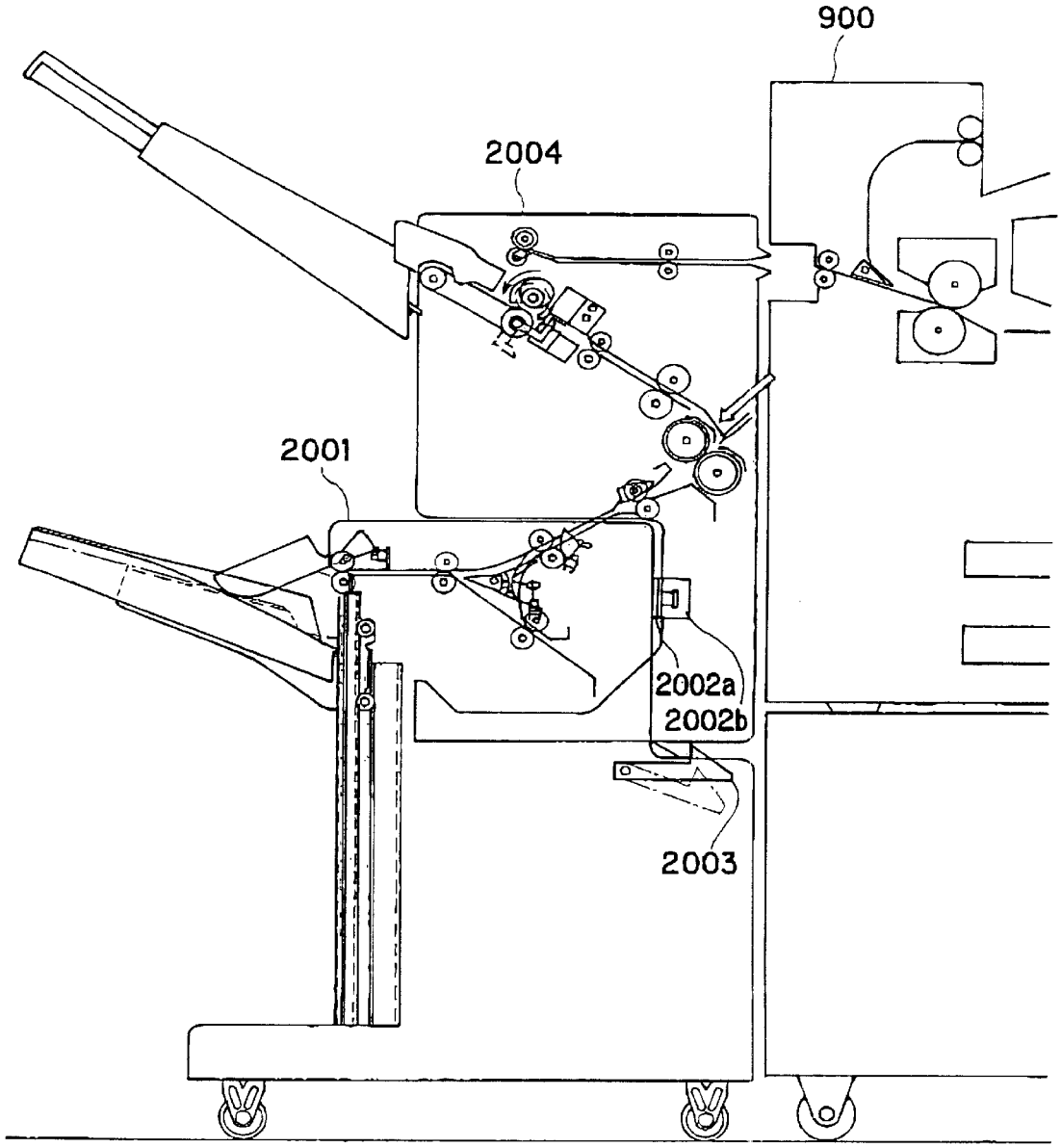
FIG. 21 is a sectional view of the sheet material conveying device in accordance with the eighth embodiment of the present invention.
Figure 22:
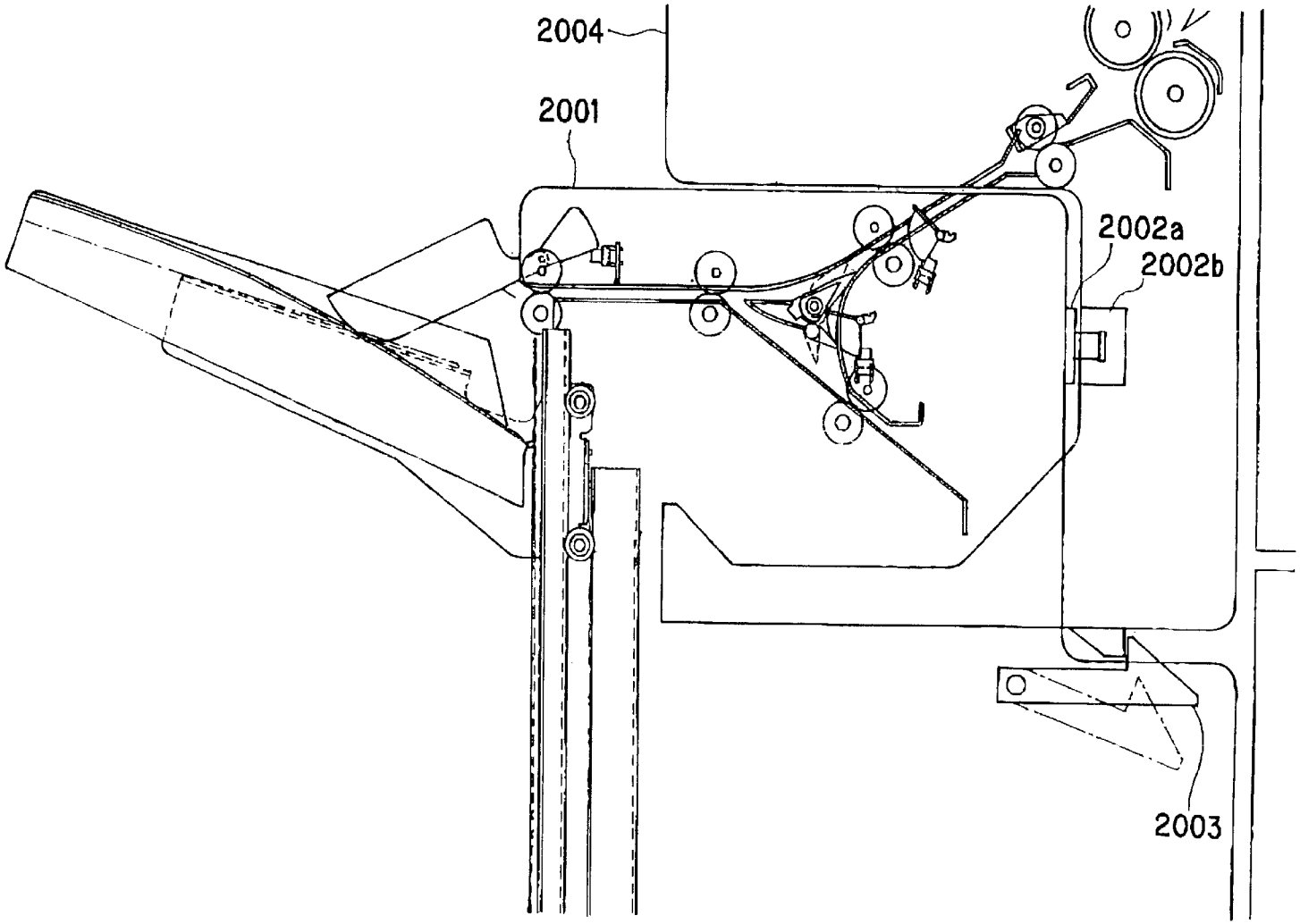
FIG. 22 is a partially enlarged view of the sheet material conveying device in accordance with the eighth embodiment of the present invention.

Here, a case in which a sheet material conveying device is freely detachable/attachable from/to a sheet post-processing device will be described with reference to FIGS. 20, 21, and 22. FIGS. 20 and 21 each are a sectional view of a sheet material conveying device in accordance with an eighth embodiment of the present invention. FIG. 22 is a partially enlarged view of the sheet material conveying device in accordance with the eighth embodiment of the present invention.

As shown in FIG. 20, in this embodiment, a sheet material conveying device 2001 is freely detachable and attachable with respect to a sheet post-processing device 2004.

Further, as shown in FIGS. 21 and 22, the sheet material conveying device 2001 is fixed to the sheet post-processing device 2004 by a fixing portion 2003. The fixing portion 2003 moves between a solid line and a broken line shown in FIG. 20, thereby conducting fixing and release between the sheet material conveying device 2001 and the sheet material post-processing device 2004.

Further, the sheet material conveying device 2001 transfers information with the sheet post-processing device 2004 through communication connectors 2002*a* and 2002*b*.

The sheet material conveying device 2001 in this embodiment is provided with a driving means for driving the entire device, a fixing means for detachably and attachably fixing the sheet material conveying device 2001 to the sheet post-processing device 2004 or the image forming apparatus 900, a communication means for conducting transfer of information such as information on a paper kind of a sheet material which is transmitted to the sheet material conveying device 2001 from the sheet post-processing device 2004 or the image forming apparatus 900, and a drive control means for controlling a drive of the driving means based on the communication result of the communication means.

For example, the motor 10002 for driving a conveying roller, the driving motor 10003 for a switchback roller, and the solenoid 10004 for a switching flapper, which are shown in FIG. 10, correspond to the driving means. In addition, the driving means may include a member for driving the sheet material conveying device.

Further, for example, the fixing means 2003 shown in FIG. 20 corresponds to the fixing means.

Further, for example, the communication connectors 2002*a* and 2002*b* shown in FIG. 20 correspond to the communication means.

Further, for example, the control circuit 10001 shown in FIG. 10 corresponds to the drive control means.

From the above, the sheet material conveying device 2001 can be handled as an independent device, and the sheet material conveying device of the present invention can be applied to various sheet post-processing devices and image forming apparatuses.

(Embodiment of Image Forming Apparatus)

Next, an embodiment of an image forming apparatus according to the present invention will be described. The embodiment of the image forming apparatus according to the present invention is provided with the sheet material conveying device in accordance with any of the first to eighth embodiments of the present invention.

That is, the image forming apparatus is provided in which a sheet material on which an image is formed by an image forming means is conveyed by the sheet material conveying device shown in any of the first to eighth embodiments to be discharged.

Further, a device to which the embodiment of the image forming apparatus according to the present invention is applied may include a printer, a facsimile, a copying machine, and the like.

An electrophotographic type image forming means, an ink-jet type image forming means, a bubble-jet type image forming means, and the like can be applied as the image forming means. However, the present invention is not limited to the above image forming means. Other appropriate image forming means can be applied.

Accordingly, in the embodiment of the image forming apparatus of the present invention, the same effect as in the first to eighth embodiments of the sheet material conveying device according to the present invention can be obtained.

What is claimed is:

1. A sheet material conveying device being capable of conveying a folded sheet material that is discharged from an image forming apparatus for forming an image on a sheet material, comprising:

a first conveying path for discharging the folded sheet as it is;

a second conveying path branching out from the first conveying path;

a third conveying path, which branches out from the second conveying path and is connected with the first conveying path, for conveying the sheet material in an opposite direction to a conveying direction of the sheet material in the second conveying path;

first switching means for selectively guiding the sheet material to either the first conveying path or the second conveying path; and second switching means for guiding the sheet material guided to the second conveying path to the third conveying path.

2. A sheet material conveying device according to claim 1, wherein:

the second conveying path is provided with a pair of conveying rollers composed of two conveying rollers for conveying a sheet material to the second conveying path;

the second conveying path is curved; and the conveying roller on the curved inner side of the pair of conveying rollers is a driving roller.

3. A sheet material conveying device according to claim 2, wherein a nip of the pair of conveying rollers is in proximity to the curved inner side.

4. A sheet material conveying device according to claim 1, wherein an inclination angle of stacking means for stacking the conveyed sheet material with respect to a horizontal plane is 20 to 45 degrees.

5. A sheet material conveying device according to claim 1, further comprising detecting means for detecting a height of a sheet material stacked on stacking means for stacking the conveyed sheet material, wherein an initial operation for controlling a height of the stacking means is performed based on the detection result of the detecting means.

6. A sheet material conveying device according to claim 5, wherein the initial operation is performed with a predetermined time interval.

7. A sheet material conveying device according to claim 5, wherein the detecting means comprises light emitting means for emitting light, light receiving means for receiving light emitted from the light emitting means, and light shielding means for shielding light which enters from the light emitting means to the light receiving means in accordance with the height of the stacking means.

8. A sheet material conveying device according to claim 1, wherein the first switching means is alternately controlled in accordance with a predetermined operation procedure sent by the image forming apparatus.

9. A sheet material conveying device according to claim 1, further comprising a sensor flag for detecting an angle of a straight line connecting at least two points on an upper surface of a sheet material on stacking means on which the conveyed sheet material is stacked, wherein a switching operation of the first switching means is controlled based on the detection result of the sensor flag.

10. A sheet material conveying device according to claim 9, wherein the sensor flag comprises at least a first sensor flag arranged on the downstream side in the conveying direction of the sheet material on the stacking means and a second sensor flag arranged on the upstream side in the conveying direction of the sheet material on the stacking means; and the sensor flag detects the angle of a straight line connecting at least two points on an upper surface of a sheet material on stacking means on which the conveyed sheet material is stacked based on detection signals output from the first sensor flag and the second sensor flag.

11. A sheet material conveying device according to claim 1, further comprising a tip end detection sensor flag for detecting a tip end of a sheet material conveyed to the first conveying path, wherein a size of the conveyed sheet material is detected based on the detection time of the tip end detection sensor flag.

12. A sheet material conveying device according to claim 1, further comprising:

a fourth conveying path for conveying a sheet material to the fist conveying path through folding processing means for conducting folding processing to the sheet material discharged from the image forming apparatus;

a fifth conveying path for conveying the sheet material discharged from the image forming apparatus to the first conveying path not through the folding processing means; and third switching means for selectively guiding the sheet material to either the fourth conveying path or the fifth conveying path.

13. A sheet material conveying device according to claim 1, further comprising:

a sixth conveying path branching out from the second conveying path;

processing means for processing a sheet material that is being conveyed through the sixth conveying path;

a seventh conveying path for conveying the sheet material discharged from the processing means to the first conveying path; and fourth switching means for switching performing conveyance of the sheet material through the sixth conveying path and not performing conveyance thereof.

14. A sheet material conveying device according to claim 13, wherein the processing means includes a Z-folding unit for Z-folding the sheet material.

15. A sheet material conveying device according to claim 13, wherein the processing means includes a puncher unit for forming a punch hole in the sheet material.

16. A sheet material conveying device according to claim 13, wherein the processing means includes a pasting processing unit for conducting pasting to the sheet material.

17. A sheet material conveying device according to claim 1, wherein at least a part of a wall of a conveying path constituting the second conveying path consists of a conveying roller.

18. A sheet material conveying device according to claim 1, wherein a stacking surface of stacking means for stacking the conveyed sheet material has a first angle that faces upward from the upstream side in the conveying direction of the sheet material to an inflection point positioned on the downstream side and has a second angle that faces downward compared with the first angle from the inflection point to the downstream side.

19. A sheet material conveying device according to claim 1, further comprising:

an eighth conveying path for discharging a sheet material as it is which is discharged from the image forming apparatus, and conveying the sheet material to a post-processing device;

a ninth conveying path branching out from the eighth conveying path;

a tenth conveying path, which branches out from the ninth conveying path, for guiding the sheet material guided to the ninth conveying path to the eighth conveying path;

fifth switching means for selectively guiding the sheet material to either the eighth conveying path or the ninth conveying path;

sixth switching means for guiding the sheet material from the ninth conveying path to the tenth conveying path; and an eleventh conveying path connected with the ninth conveying path and connected with the first conveying path.

20. A sheet material conveying device according to claim 19, wherein the post-processing device is a stapling unit for conducting stapling processing to the sheet material.

21. A sheet material conveying device according to claim 19, further comprising a twelfth conveying path for conveying the sheet material to the first conveying path through folding processing means for conducting folding processing to the sheet material discharged from the post-processing device.

22. A sheet material conveying device according to claim 19, further comprising a thirteenth conveying path for conveying the sheet material to the first conveying path not through folding processing means for conducting folding processing to the sheet material discharged from the post-processing device.

23. A sheet material conveying device according to claim 19, further comprising:

driving means for driving the entire device;

fixing means for detachably and attachably fixing the sheet material conveying device to the post-processing device;

communication means for conducting transfer of information between the sheet material conveying device and the post-processing device; and drive control means for controlling a drive of the driving means based on the communication result of the communication means.

24. An image forming apparatus, comprising image forming means for forming an image on a sheet material, wherein the sheet material on which the image is formed is discharged to the sheet material conveying device as claimed in any of claims 1 to 23 by means of the image forming means.

25. A sheet processing device, comprising:

a pair of folding rollers for sandwiching a loop portion formed in a sheet and folding the sheet;

a pair of discharge rollers for discharging a sheet;

a first conveying path for guiding the sheet folded by the pair of folding rollers to the pair of discharge rollers;

a pair of switchback rollers for conveying the sheet in a switchback manner;

a switching flapper for selectively guiding the sheet to the first conveying path or the pair of switchback rollers; and a guide for guiding the sheet, which has been guided to the pair of switchback rollers by the switching flapper and conveyed in a switchback manner by the switchback rollers, so that the sheet joins the first conveying path.

26. A sheet processing device according to claim 25, wherein the switching flapper guides second predetermined number of sheets, which is at least one, to the pair of switchback rollers every time the switching flapper guides first predetermined number of sheets, which is at least one, to the first conveying path.

27. A sheet processing device according to claim 25 or 26, further comprising a control circuit for controlling the switching flapper and the switchback rollers.

28. An image forming apparatus, comprising image forming means for forming an image on a sheet and the sheet processing device as claimed in claim 25 for conducting processing to the sheet on which the image is formed by the image forming means.

* * * * *

UNITED STATES PATENT AND TRADEMARK OFFICE

CERTIFICATE OF CORRECTION

PATENT NO. : 6,733,007 B2
DATED : May 11, 2004
INVENTOR(S) : Junichi Sekiyama et al.

It is certified that error appears in the above-identified patent and that said Letters Patent is hereby corrected as shown below:

Title page,
Item [57], ABSTRACT,
Line 4, "include:" should read -- includes: --
Line 6, "path" should read -- path; --.

Column 1,
Line 10, "processingan," should read -- processing, an --.
Line 33, “staking” should read -- stacking --.

Column 2,
Line 25, "decrees." should read -- degree. --.

Column 3,
Line 14, "fist" should read -- first --.

Column 7,
Line 40, "Preferred" should read -- preferred --.
Line 57, "area" should read -- is a --.

Column 8,
Lines 29 and 31, "curve" should read -- curved --.

Column 9,
Line 34, "massed” should read -- passed --.

Column 10,
Line 52, "arriving the" should read -- arriving on the --.

Column 12,
Line 18, "phlet p" should read -- phlet P --.

Column 14,
Line 33, "seperatable to" should read -- separatable from --.

Column 15,
Line 19, "to-the" should read -- to the --.
Line 48, "shown" should read -- shows --.

UNITED STATES PATENT AND TRADEMARK OFFICE

CERTIFICATE OF CORRECTION

PATENT NO. : 6,733,007 B2
DATED : May 11, 2004
INVENTOR(S) : Junichi Sekiyama et al.

It is certified that error appears in the above-identified patent and that said Letters Patent is hereby corrected as shown below:

Column 20,
Line 67, "are" should read -- is --.

Signed and Sealed this

Twenty-fourth Day of August, 2004

JON W. DUDAS
*Director of the United States Patent and Trademark Office*